US010555605B1

(12) United States Patent
Berger

(10) Patent No.: US 10,555,605 B1
(45) Date of Patent: Feb. 11, 2020

(54) MODULAR SHELVING

(71) Applicant: Craig R Berger, Brooklyn, NY (US)

(72) Inventor: Craig R Berger, Brooklyn, NY (US)

( * ) Notice: Subject to any disclaimer, the term of this patent is extended or adjusted under 35 U.S.C. 154(b) by 0 days.

(21) Appl. No.: 16/251,003

(22) Filed: Jan. 17, 2019

Related U.S. Application Data

(63) Continuation of application No. 16/249,787, filed on Jan. 16, 2019, now abandoned.

(51) Int. Cl.
*A47B 47/04* (2006.01)

(52) U.S. Cl.
CPC ..... *A47B 47/047* (2013.01); *A47B 47/042* (2013.01); *A47B 2230/0081* (2013.01)

(58) Field of Classification Search
CPC ..... A47B 47/047; A47B 47/042; A47B 2230/0081
USPC .... 403/331, 354, 364, 205; 220/23.4, 23.83, 220/23.86; 312/108, 111; 211/186, 189; 52/668, 79.1
See application file for complete search history.

(56) References Cited

U.S. PATENT DOCUMENTS 757,812 A * 4/1904 Keyes ..... E04B 1/2604 403/364
761,103 A * 5/1904 Richards ..... A47B 87/02 312/108
1,630,140 A * 5/1927 Sibbald ..... A21B 3/132 220/552
2,069,391 A * 2/1937 Sample ..... A47G 27/0218 52/668
2,288,104 A * 6/1942 Pasquier ..... 52/302.3
2,366,677 A * 1/1945 Rosenthal ..... A47B 47/042 108/60
2,368,502 A * 1/1945 Troiel ..... B28B 7/0088 249/132
2,645,985 A * 7/1953 Beebe ..... E04C 2/423 52/667
2,832,100 A * 4/1958 Swallert ..... A63H 33/06 52/284

(Continued)

FOREIGN PATENT DOCUMENTS

DE 19705107 A1 * 8/1998 ..... A47B 47/042
EP 0593407 A1 * 4/1994 ..... A47B 47/042
FR 2968524 A1 * 6/2012 ..... A47B 47/042

OTHER PUBLICATIONS (Author unknown), "Steven Caney's Ultimate Building Book," https://books.google.com/books?d=AkfBLZzcl2gC&Ipg=PA488&ots=nRVciCIXd3&dq=make%20boxes%20out%20of%20slotted%20panels&pg=PA487%23v=twopage&q=make%20boxes%20out%20of%20slotted%20panels&f=true, appeared on the web before the filing date of the current application.

(Continued)

*Primary Examiner* — Jonathan Liu
*Assistant Examiner* — Devin K Barnett
(74) *Attorney, Agent, or Firm* — Muskin and Farmer LLC

(57) ABSTRACT

A method and system to create a modular shelving or storage unit. Different pieces are provided which are configured to be joined together (by sliding) without using any adhesive and can form a box. A plurality of boxes can then be joined together by sliding them together to form a plurality of joined boxes. As such, a custom, modular shelf can be easily constructed by a user simply by joining the pieces which are already provided to him/her. In this manner, custom shelfs can be easily constructed which would fit most any area of physical space.

16 Claims, 23 Drawing Sheets

(56) References Cited

U.S. PATENT DOCUMENTS 3,069,216 A * 12/1962 Vaeth ..... A47B 47/042 312/195
3,195,507 A * 7/1965 Miller ..... A01K 31/14 119/431
3,552,817 A * 1/1971 Marcolongo ..... A47B 87/02 312/107
3,807,116 A * 4/1974 Flynn ..... E04C 2/36 52/793.11
4,153,311 A * 5/1979 Takahashi ..... A47B 47/042 312/107
4,192,562 A * 3/1980 Bishoff ..... A47B 87/02 211/189
4,196,812 A 4/1980 Mcinnis
4,232,916 A 11/1980 Correia
4,545,165 A * 10/1985 Carey ..... E04B 9/345 403/346
4,582,002 A * 4/1986 Wright ..... A47B 47/042 108/60
4,807,539 A * 2/1989 Del Castillo von Haucke ..... A47B 17/00 108/60
4,832,421 A * 5/1989 Shoffner ..... A47B 47/042 312/263
4,934,588 A 6/1990 Johnske
4,945,689 A * 8/1990 Johnson, Jr. ..... E01C 11/16 52/668
5,052,580 A * 10/1991 Khoury ..... B60R 7/02 220/505
5,335,753 A * 8/1994 Campbell ..... B25H 1/06 182/151
5,423,463 A 6/1995 Weeks
5,460,277 A 10/1995 Silva
5,463,786 A * 11/1995 Mangone ..... E01D 19/125 14/73
5,695,081 A 12/1997 Alkalay
5,722,544 A 3/1998 Williams
5,775,046 A * 7/1998 Fanger ..... A47B 81/06 108/157.16
5,971,165 A 10/1999 Levins
6,174,116 B1 1/2001 Brand
6,378,707 B1 4/2002 Taggert
6,421,970 B1 * 7/2002 Martensson ..... E04B 1/6129 52/282.1
6,532,878 B2 3/2003 Tidemann
6,588,166 B2 * 7/2003 Martensson ..... E04B 1/6129 52/578
6,615,999 B1 9/2003 Culp
6,619,749 B2 9/2003 Willy
6,817,806 B1 * 11/2004 Arellanes ..... E02B 3/108 405/111
6,845,871 B1 1/2005 Culp
7,114,300 B1 10/2006 Culp
D542,936 S * 5/2007 Ng ..... D25/58
7,210,416 B1 5/2007 Grigsby, Jr.
7,591,611 B2 * 9/2009 Arellanes ..... E02B 3/108 405/111
7,601,069 B2 10/2009 Freres
7,775,419 B2 * 8/2010 Bale ..... B31D 5/0013 229/120.36
8,220,399 B2 7/2012 Berent et al.
8,458,980 B2 * 6/2013 Ivanov ..... A63H 33/084 446/105
8,459,205 B1 6/2013 Patt
8,621,739 B1 1/2014 Elliot
8,662,326 B2 3/2014 Brick
8,832,917 B1 9/2014 Elliott
8,919,363 B1 * 12/2014 Johnson ..... A47F 7/0035 135/128
8,955,928 B2 * 2/2015 Cheng ..... A47F 5/0018 220/4.33
9,282,816 B2 * 3/2016 Ahart ..... A47B 47/0091
9,332,838 B1 5/2016 Kilday et al.
9,556,605 B2 * 1/2017 Elliott ..... A63H 33/008
9,615,663 B2 4/2017 Davis
9,833,085 B2 12/2017 Adair
9,874,307 B1 * 1/2018 Del Castillo ..... F16M 11/22
9,909,604 B1 * 3/2018 Fawcett ..... F16B 12/125
10,362,879 B2 * 7/2019 Lee ..... A47C 19/005
2001/0035385 A1 * 11/2001 Sosso ..... A47F 5/005 211/184
2001/0037987 A1 * 11/2001 Culp ..... A47B 47/042 211/186
2003/0066814 A1 * 4/2003 Wang ..... A47B 47/0075 211/189
2004/0108290 A1 6/2004 David
2006/0086779 A1 * 4/2006 Meyer ..... B65D 5/48038 229/120.32
2006/0113303 A1 * 6/2006 Huruta ..... B65D 21/0204 220/23.4
2006/0209815 A1 9/2006 Castro-Estevez et al.
2006/0243784 A1 * 11/2006 Glaser ..... B65D 5/4608 229/117.16
2008/0006596 A1 * 1/2008 Palmeri ..... A47B 47/0016 211/189
2008/0025790 A1 * 1/2008 Kozhuev ..... F16B 5/008 403/364
2008/0217275 A1 * 9/2008 Chen ..... A47B 73/006 211/194
2008/0217389 A1 * 9/2008 Bos ..... B65D 5/48038 229/120.36
2009/0309464 A1 12/2009 Schwartz
2010/0093257 A1 * 4/2010 Elliott ..... A47B 3/06 446/478
2010/0170174 A1 * 7/2010 Wangdak ..... A47B 47/042 52/270
2011/0079637 A1 * 4/2011 Vroon ..... B65D 25/04 229/120.07
2011/0158744 A1 * 6/2011 Dornfeld ..... F16D 1/076 403/364
2012/0060765 A1 3/2012 Hough
2012/0240381 A1 * 9/2012 Carey ..... B21D 39/037 29/525.01
2012/0312764 A1 * 12/2012 Walter ..... A47F 5/083 211/105.1
2013/0292351 A1 * 11/2013 Wyatt ..... A47B 47/042 211/188
2014/0059956 A1 3/2014 Kerian
2014/0263138 A1 9/2014 Koch
2015/0265047 A1 * 9/2015 Menard ..... A47B 47/042 211/186
2018/0112696 A1 * 4/2018 Davis ..... A47B 47/042
2019/0040890 A1 * 2/2019 Davis ..... F16B 5/0012
2019/0059594 A1 * 2/2019 Davis ..... A47C 4/021

OTHER PUBLICATIONS (Author unknown), Amazon, "Slot-Together Translucent Builders," https://www.amazon.com/Lakeshore-Learning-Materials-Slot-Together-Translucent/dp/B004ZAKJPW, appeared on the web before the filing date of the current application.

(Author unknown), Make-Community, "CNC Panel Joinery Notebook," https://makezine.com/2012/04/13/cnc-panel-joinery-notebook/, appeared on the web before the filing date of the current application.

(Author unknown), Ponoko, "How To Make Interlocking Wood Designs," http://support.ponoko.com/entries/498853-How-to-make-interlocking-wood-designs, appeared on the web before the filing date of the current application.

(Author unknown), Farwell Manor, "DIY Slot-Together Dollhouse," http://farwellmanor.blogspot.com/2013/01/day-368-diy-slot-together-dollhouse.html, appeared on the web before the filing date of the current application.

(Author unknown), Railway Sleeper, "Railway Sleeper," http://www.railwaysleeper.co.uk/heavyweight-oak-raised-bed-kit-herb-

(56) References Cited

OTHER PUBLICATIONS boxes-railway-sleeper-p-190.html, appeared on the web before the filing date of the current application.

* cited by examiner

MODULAR SHELVING

BACKGROUND OF THE INVENTION

Field of the Invention

The present general inventive concept is directed to a method and apparatus for providing interlocking modular shelving and storage.

Description of the Related Art

Modular furniture has been developed which allows a user to stack premade pieces together.

SUMMARY OF THE INVENTION

It is an aspect of the present invention to provide an improved method and system for modular shelving and storage.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1A:
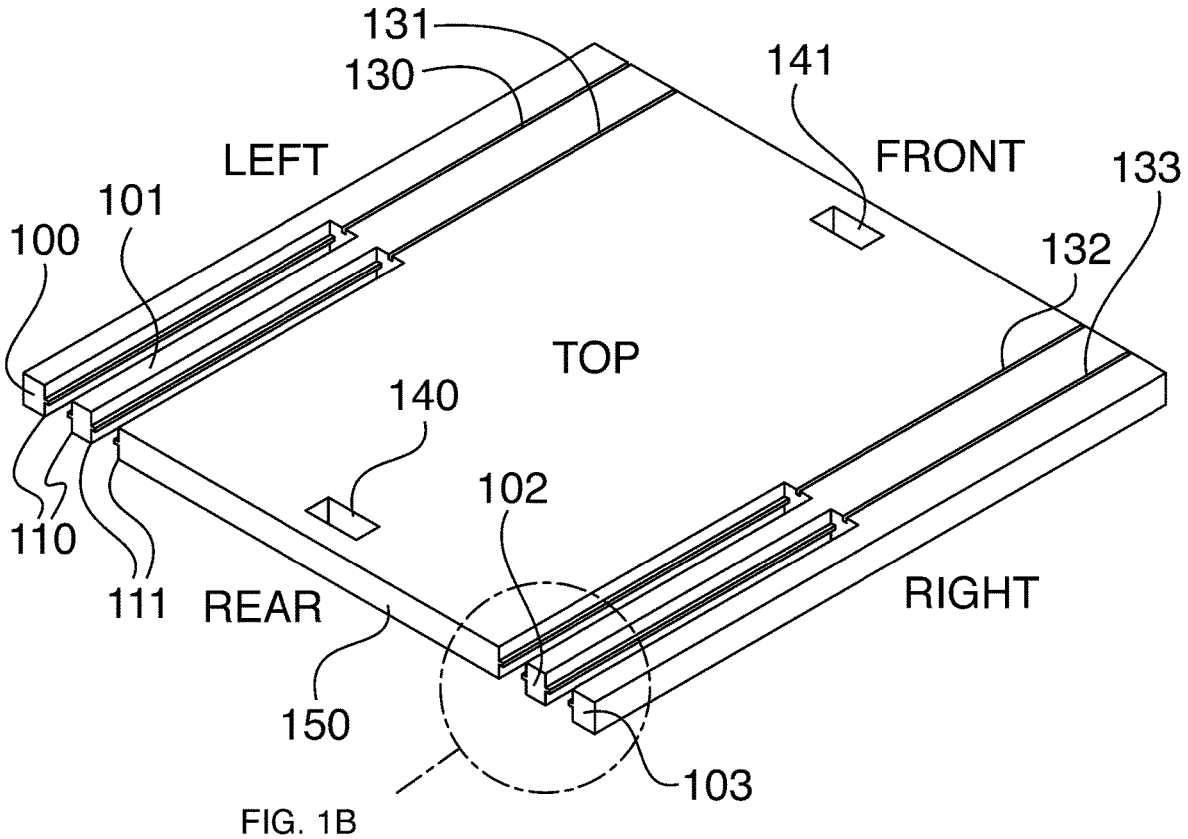
FIG. 1A is a diagonal top view of a first piece, according to an embodiment.

Reference will now be made in detail to the presently preferred embodiments of the invention, examples of which are illustrated in the accompanying drawings, wherein like reference numerals refer to like elements throughout.

The inventive concept relates to a modular shelving and storage system. A plurality of pieces are provided, each piece can interconnect into other of the plurality pieces. A kit can be provided of a large quantity of the different pieces so a user can construct a shelve utilizing different configurations of the pieces.

There are five main types of pieces described herein, a first piece, a second piece, a third piece, a fourth piece, and a fifth piece. Each of the types of pieces would typically be identical to the other pieces of the same type. All of the pieces can be made from wood, although other materials can be used as well such as metal, plastic (typically hard), laminate, bamboo, etc. The material used should typically be smooth.

The pieces can be connected to one another by sliding the pieces into each other without the need for any type of adhesives (e.g., glue, etc.) or permanent connectors (e.g., nails, etc.) Note that optionally, adhesives can still be used (e.g., glue, nails, etc.) if the user wants to create a permanent structure, but such adhesives are not required. The pieces are constructed and configured such that the channel(s) of one piece will slide into/through a corresponding channel(s) of another piece, and ridges of one piece will slide into/through corresponding grooves of another piece.

The pieces can be supplied in kit form, for example any number of each of the pieces can be provided in a large container (e.g., 20-100 (or any other number) pieces of each type).

Figure 1B:
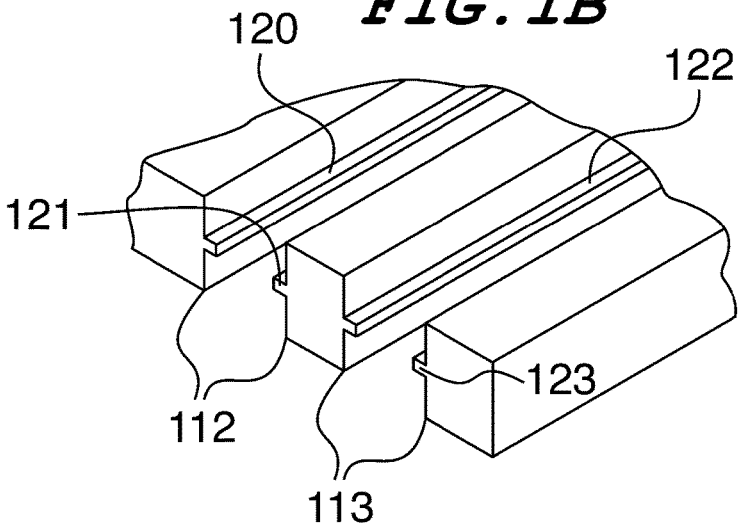
FIG. 1B is an enlarged drawing of the circled portion in FIG. 1A, according to an embodiment.

FIG. 1A is a diagonal top view of a first piece, according to an embodiment. FIG. 1B is an enlarged drawing of the circled portion in FIG. 1A, according to an embodiment.

The first piece (piece one) has only four tines 100 (first tine), 101 (second tine), 102 (third tine), 103 (fourth tine) all on the rear side. The first piece is symmetrical on the left/right side (in other words the left side and right side are mirror images of each other). Between (or adjacent) to each tine are channels 110, 111, 112, 113, all located on the rear side (with no channels on the front side). A middle section 150 is between the second channel 111 and the third channel 112. Note that the middle section 150 is larger than all of the tines and all of the channels. On the left side and right side of each channel are ridges. For example, channel 112 has left ride 120 and right ridge 121, channel 113 has left ridge 122 and right ridge 123. Extending past each channel are grooves 130, 131, 132, 133. The ridges are all configured to slide through grooves on another piece (whether the same type or different piece). Note that there are pairs of opposing grooves, for example a first pair of grooves 130 extends past the first channel 110, with the first pair of grooves 130 comprising a groove being on the top side and an opposing groove being on the bottom side (not visible in FIG. 1A but exists opposite the groove 130 shown). In this manner a left ridge (or right ridge) in a channel of another piece would slide into the top groove and the opposite right ridge (or left ridge) of the same channel of the another piece would slide into the bottom groove, thereby providing stability to the connection. Each of the channels 110, 111, 112, 113 would have a corresponding pair of grooves that extends past the channel. The grooves and the left/right ridges (of the other pieces) are all configured (with the proper locations, dimensions, etc.) to cooperate and fit/slide together. Typically when one piece is connected to another piece the pieces are held perpendicular to each other so that the channels can slide into each other and both pairs of grooves would slide along each pair of ridges of the other piece. Two holes are present a front hole 141 and a rear hole 140 can be used to insert a backing (discussed elsewhere).

All channels (in all pieces) would run from an end (front or rear) of the piece to the middle (between the front and rear) of the piece (or near the middle such as within an inch from the middle). All channels would also be parallel to all other channels in the same piece. All tines would also be parallel to all other tines in the same piece. All pieces can be rectangular (note that a square is considered a rectangle).

Note that the top half and bottom half of the first piece (and all other pieces) are symmetrical. Also note that if all parts of the first piece (and all other pieces) are not clearly shown in the drawings, these parts can all be discerned by the shown parts because the structure of the same parts of each piece are identical. For example, in FIG. 1B, the right ridge 123 of the channel 113 is not entirely shown, but the right ridge 123 of the channel 113 would have the same structure as all other ridges (in the first piece and other pieces). All tines and channels (and other parts) on all pieces would have identical dimensions (length, width, etc.) Thus, from the figures, the structure of each part can easily be discerned even if not shown in its entirety. The structure of all pieces are consistent with each other (a piece's own other parts as well as the parts of other pieces). The structure of the ridges (in all pieces) are such that they are configured to fit tightly but slide through the grooves of all other pieces that those ridges can contact. The channels of all pieces are also configured to fit and slide through channels of all other pieces until they meet at the end of each channel (at or near the middle of each piece). In other words, when each piece is slided into another piece, they will meet at the middle of each piece. The ridges will slide through the corresponding grooves of the other piece This universal structure/configuration which is common to all of the pieces allows each piece to fit (slide) into any other of the pieces. All piece types can even slide into another piece of the same type.

Note that all of the other pieces will use the same descriptive terms (e.g., tines, channels, middle section, etc.) and will have the same general structure (middle section in the middle between channels, etc.) For example, all channels in all pieces would typically have a pair of grooves (on top and bottom) extending past the channel so that the left/right ridges of a connecting piece would slide through the grooves. Unless otherwise noted, the other drawings of the other pieces will show/use the same orientation as the first piece is drawn.

Because all pieces have compatible structures, dimensions, dimensions of parts, etc., a user can create customized structures by sliding a plurality of pieces together into other pieces thereby creating a stable interlocking structure. There is no limit to the number of pieces that can be joined together. As such, custom shelving (and other utilitarian structures) can be created which can fit particular desired dimensions.

Figure 1C:
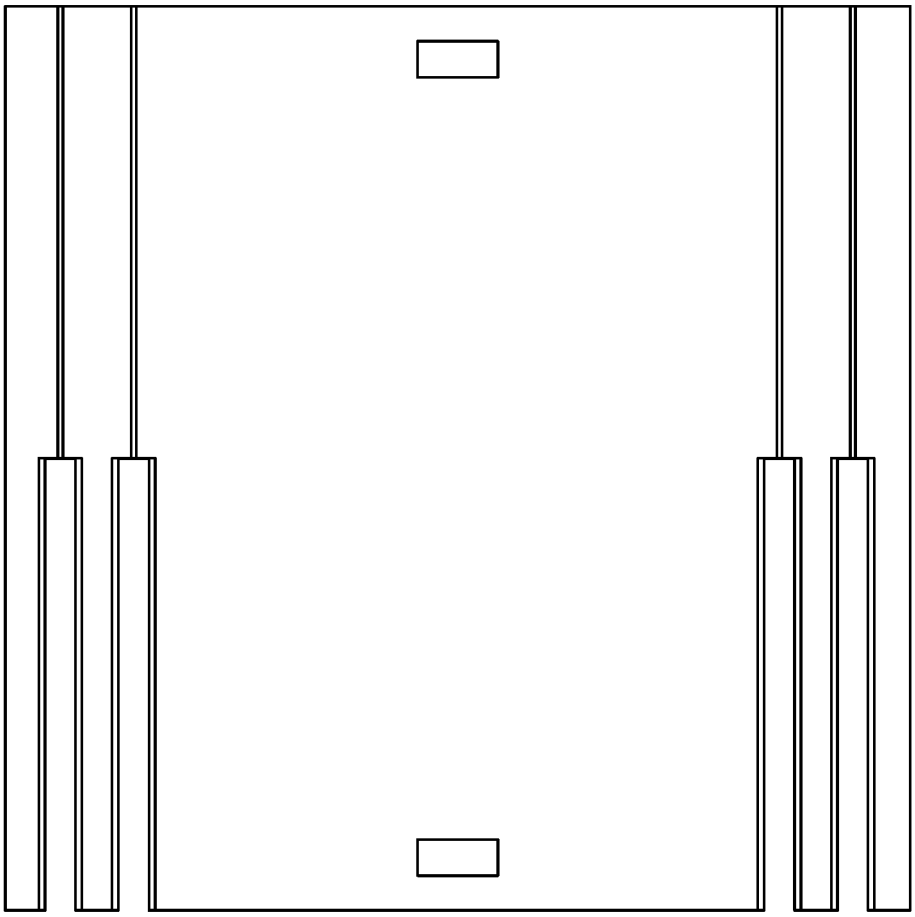
FIG. 1C is a bottom view of the first piece, according to an embodiment.

FIG. 1C is a bottom view of the first piece, according to an embodiment.

The bottom half of each piece is identical to top half.

Figure 1D:
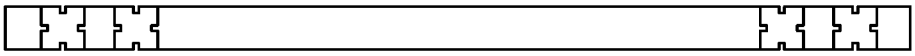
FIG. 1D is a rear view of the first piece, according to an embodiment.

FIG. 1D is a rear view of the first piece, according to an embodiment.

The left and right ridges of each channel are shown, as well as the upper and lower groove behind each channel. Note that the middle section 150 is larger (in the horizontal axis/direction shown in FIG. 1D) than the size (in the same horizontal axis/direction shown in FIG. 1D) of each of the tines 100, 101, 102, 103, and the middle section 150 is larger (in the horizontal axis/direction shown in FIG. 1D) than the size (in the same horizontal axis/direction shown in FIG. 1D) of each of the channels 110, 111, 112, 113.

Figure 1E:
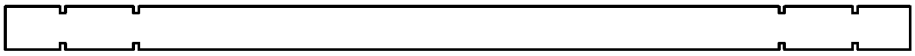
FIG. 1E is a front view of the first piece, according to an embodiment.

FIG. 1E is a front view of the first piece, according to an embodiment.

The upper and lower grooves of in front of each channel are shown.

Note that in FIGS. 2A, 2B, 2C, 2D, 2E, 3A, 3B, 3C, 3D, 3E, 4A, 4B, 4C, 4D, 4E, 5A, 5B, 5C, 5D, 5E, 6A, 6B, 6C, the view nomenclature/references are identical to that shown/described in FIGS. 1A, 1B, 1C, 1D, 1E.

Figure 2A:
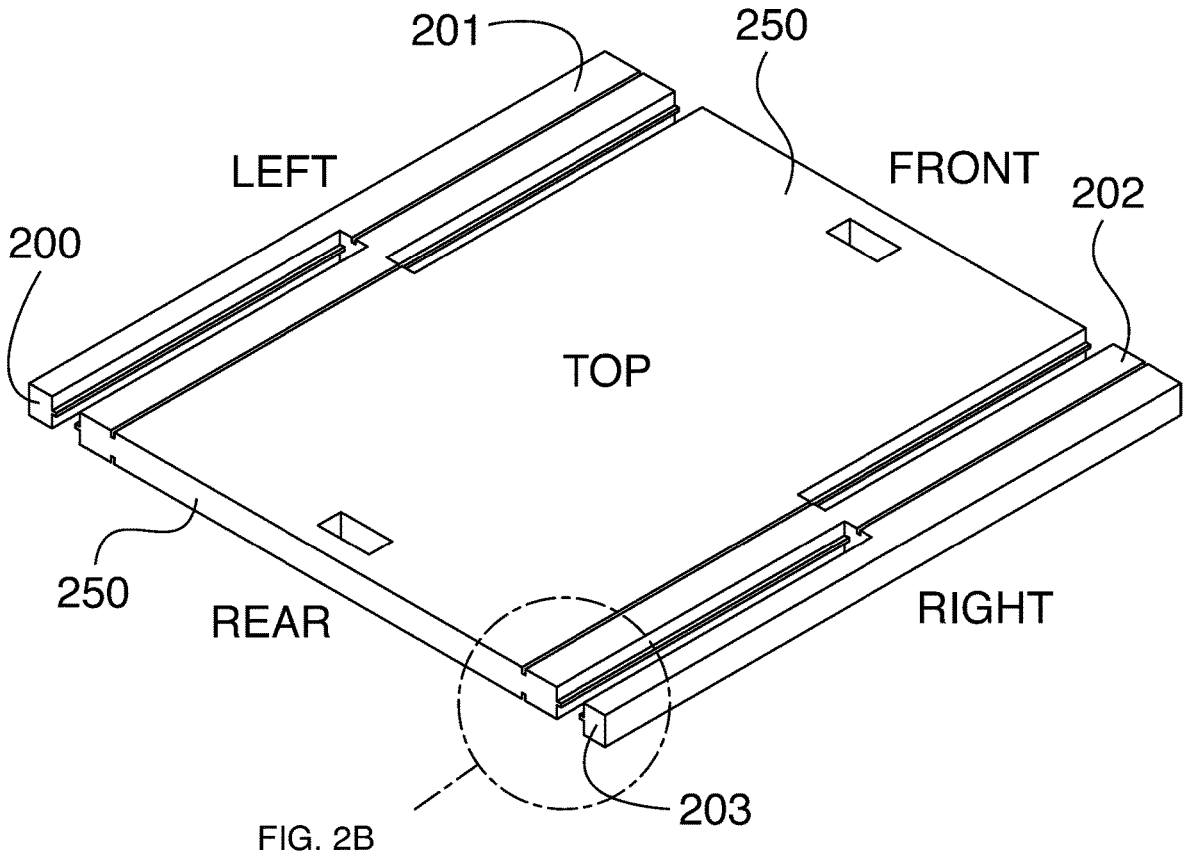
FIG. 2A is a diagonal top view of a second piece, according to an embodiment.
Figure 2B:
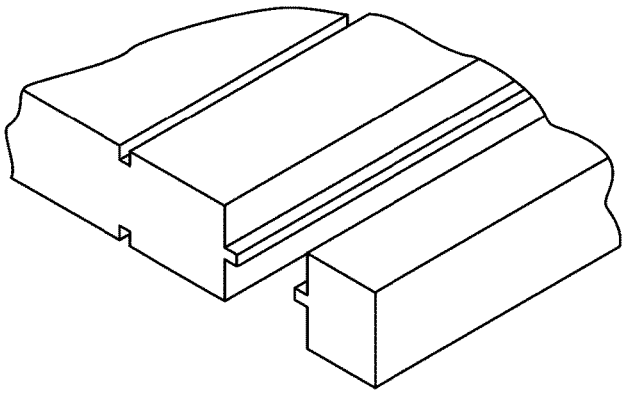
FIG. 2B is an enlarged drawing of the circles portion of FIG. 2A, according to an embodiment.

FIG. 2A is a diagonal top view of a second piece, according to an embodiment. FIG. 2B is an enlarged drawing of the circles portion of FIG. 2A, according to an embodiment.

The second piece (piece two) has four tines, 200 (first), 201 (second), 202 (third), 203 (fourth) two in front 201, 202, and two in the rear 200, 203. Piece two also has four channels, two in the front and two in the rear. As shown, the locations of the channels (from left to right) is as follows: rear, front, front, rear. A first channel is located between the first tine 200 and a middle section 250, a second channel is located between the second tine 201 and the middle section 250, a third channel is located between the third tine 202 and the middle section 250, and a fourth channel is located between the fourth tine 203 and the middle section 250. As all of the pieces, the upper (top) half of piece two is symmetrical (identical) to the lower (bottom) half. The left side of piece two is a mirror image of the right side. The middle section 250 is between the pair of channels on one end and the pair of channels on the opposite end. The front half of piece two is not a mirror image of the rear half of piece two.

Figure 2C:
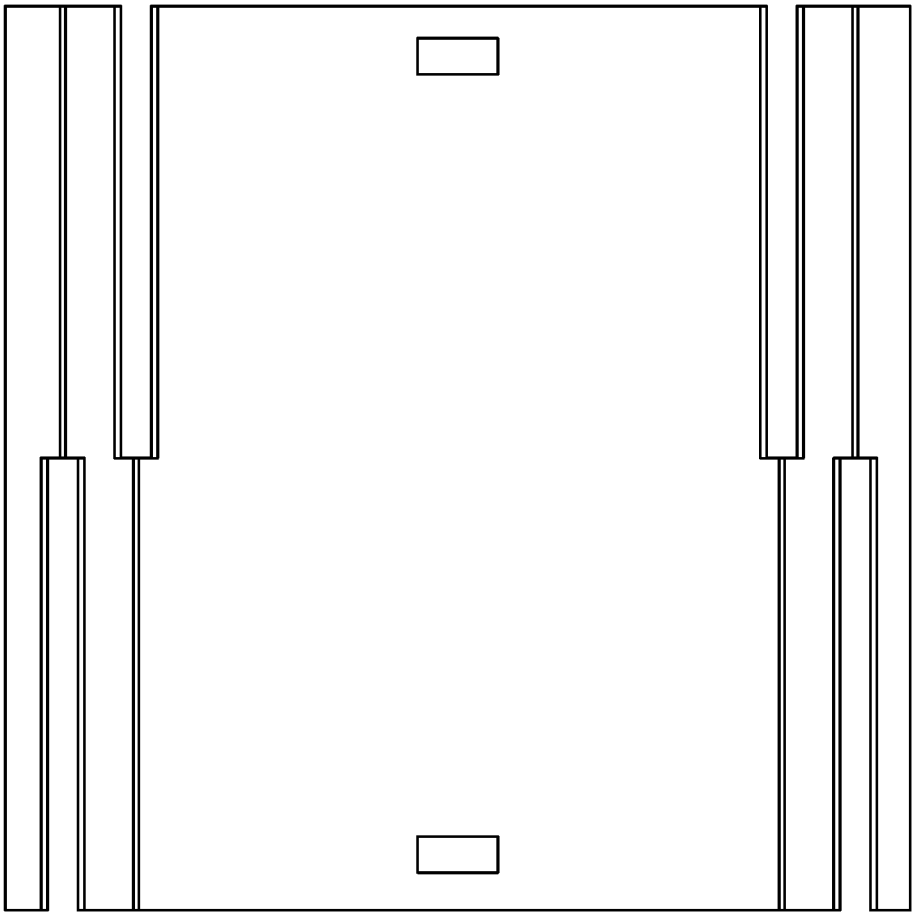
FIG. 2C is a bottom view of the second piece, according to an embodiment.
Figure 2D:
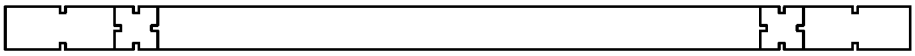
FIG. 2D is a front view of the second piece, according to an embodiment.
Figure 2E:
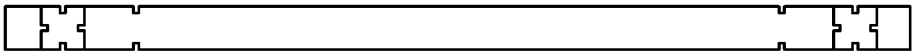
FIG. 2E is a rear view of the second piece, according to an embodiment.

FIG. 2C is a bottom view of the second piece, according to an embodiment. FIG. 2D is a front view of the second piece, according to an embodiment. FIG. 2E is a rear view of the second piece, according to an embodiment.

Figure 3A:
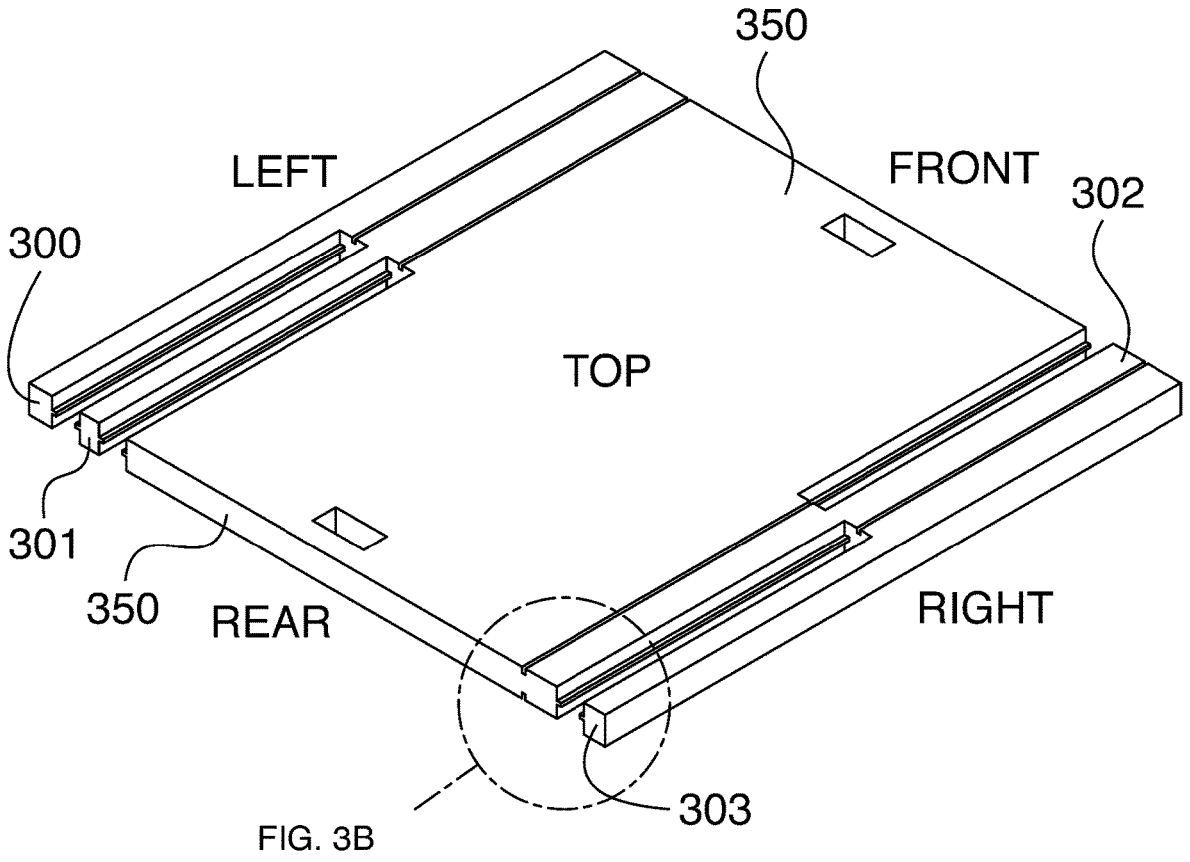
FIG. 3A is a diagonal top view of a third piece, according to an embodiment.
Figure 3B:
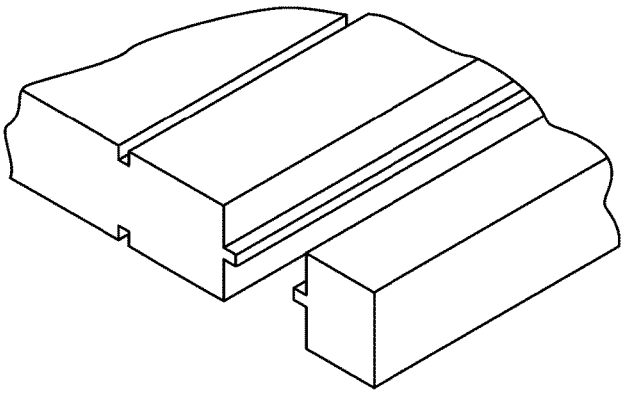
FIG. 3B is an enlarged drawing of the circles portion of FIG. 3A, according to an embodiment.

FIG. 3A is a diagonal top view of a third piece, according to an embodiment. FIG. 3B is an enlarged drawing of the circles portion of FIG. 3A, according to an embodiment.

The third piece (piece three) has four tines 300 (first), 301 (second), 302 (third), 304 (fourth), one (302) in front and three (300, 301, 303) in the rear. Piece three also has four channels, three in the front (first channel, second channel, fourth channel from left to right) and one in the rear (third channel). A first channel is located between the first tine 300 and the second tine 301, a second channel located between the second tine 301 and a middle section 350, a third channel located between the middle section 350 and the third tine 302, and a fourth channel located between the middle section 350 and the fourth tine 303. The middle section 350 is between the second channel and the third channel and also between the second channel and the fourth channel. As shown, the locations of the channels (from left to right) is as follows: rear, rear, front, rear. As all of the pieces, the upper (top) half of piece three is symmetrical (identical) to the lower (bottom) half. The left side of piece three is not a mirror image of the right side. The front half of piece three is not a mirror image of the rear half of piece three.

Figure 3C:
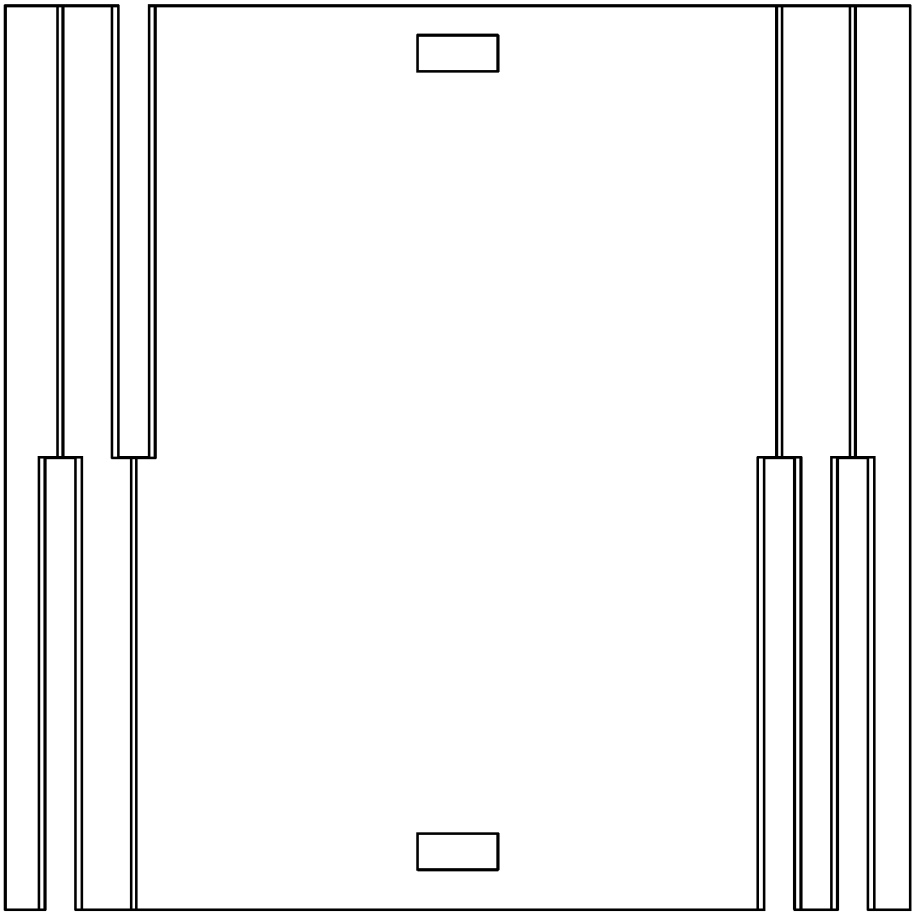
FIG. 3C is a bottom view of the third piece, according to an embodiment.
Figure 3D:
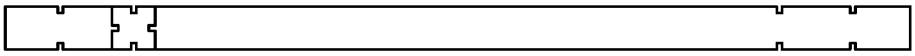
FIG. 3D is a front view of the third piece, according to an embodiment.
Figure 3E:
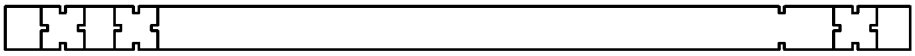
FIG. 3E is a rear view of the third piece, according to an embodiment.

FIG. 3C is a bottom view of the third piece, according to an embodiment. FIG. 3D is a front view of the third piece, according to an embodiment. FIG. 3E is a rear view of the third piece, according to an embodiment.

Figure 4A:
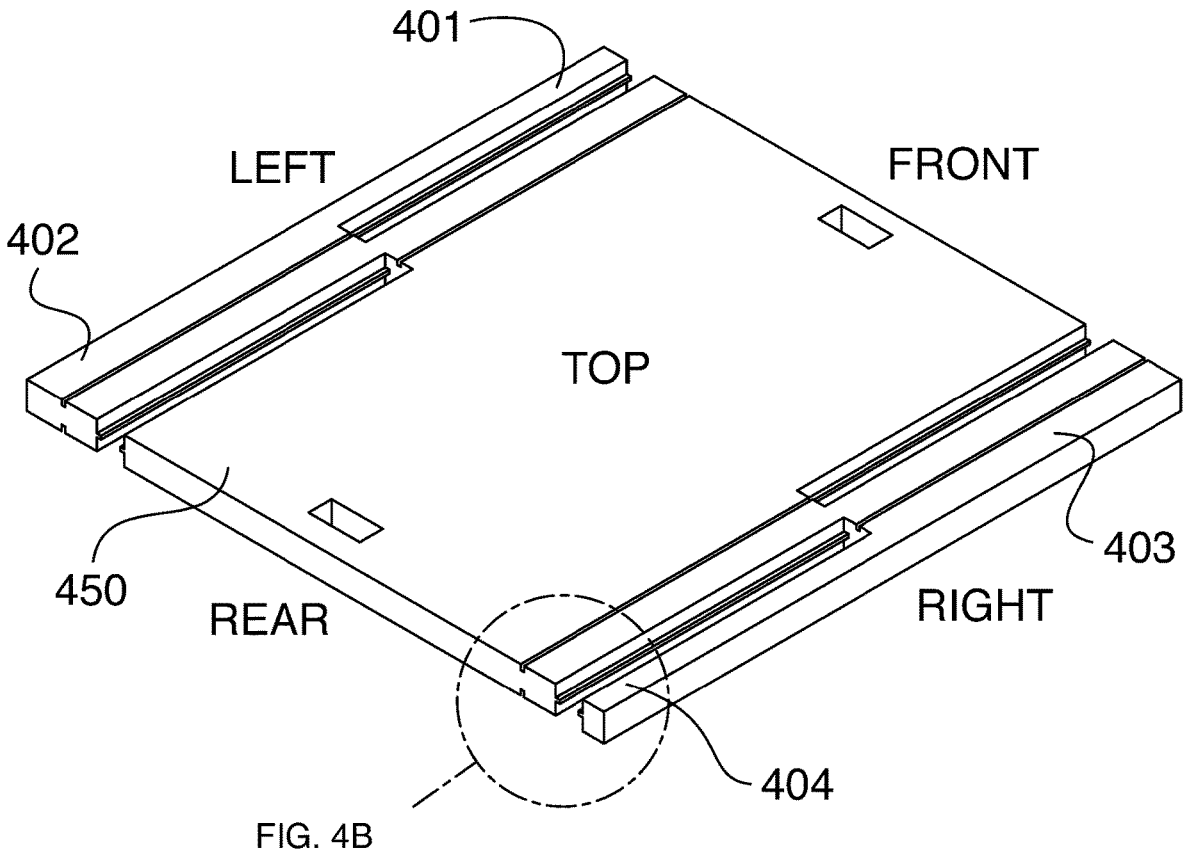
FIG. 4A is a diagonal top view of a fourth piece, according to an embodiment.
Figure 4B:
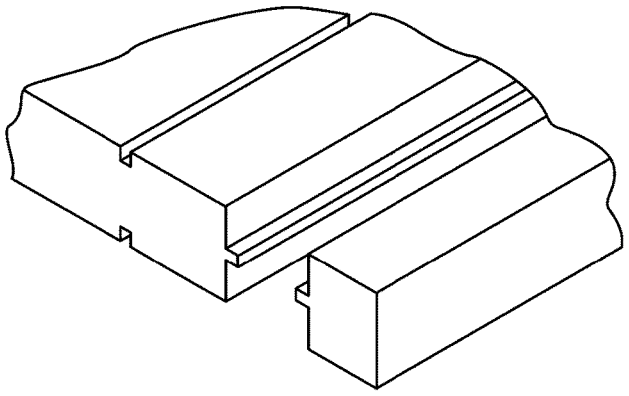
FIG. 4B is an enlarged drawing of the circles portion of FIG. 4A, according to an embodiment.

FIG. 4A is a diagonal top view of a fourth piece, according to an embodiment. FIG. 4B is an enlarged drawing of the circles portion of FIG. 4A, according to an embodiment.

The fourth piece (piece four) has four tines, 401 (first), 402 (second), 403 (third), 404 (fourth), two in front 401, 403, and two in the rear 402, 404. A middle section 450 is also present. Piece four also has four channels, two in the front and two in the rear. A first channel is located between the first tine 401 and the middle section 450, a second channel is located between the second tine 402 and the middle section 450, a third channel is located between the third tine 403 and the middle section 450, and a fourth channel is located between the fourth tine 404 and the middle section 450. As shown, the locations of the channels (from left to right) is as follows: front, rear, front, rear. As all of the pieces, the upper (top) half of piece four is symmetrical (identical) to the lower (bottom) half. The left side of piece four is not a mirror image of the right side. The front half of piece four is not a mirror image of the rear half of piece four.

Figure 4C:
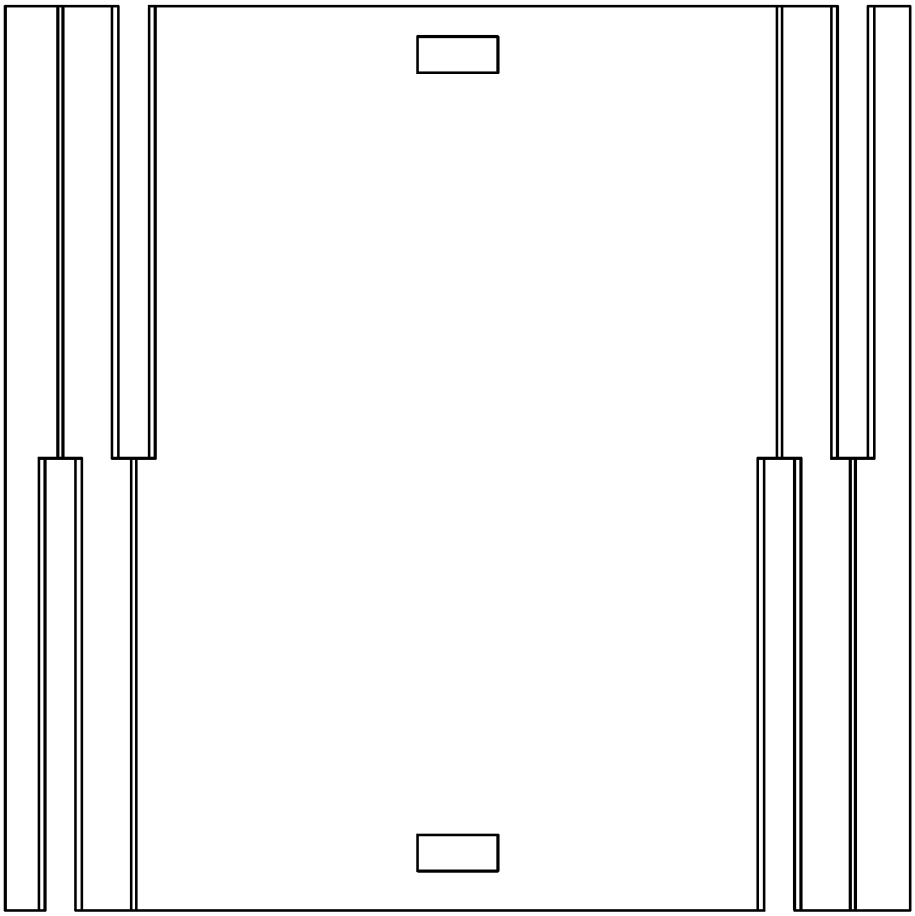
FIG. 4C is a bottom view of the fourth piece, according to an embodiment.
Figure 4D:
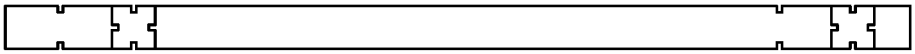
FIG. 4D is a front view of the fourth piece, according to an embodiment.
Figure 4E:
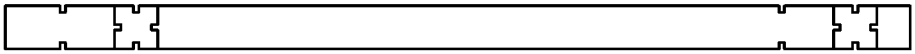
FIG. 4E is a rear view of the fourth piece, according to an embodiment.

FIG. 4C is a bottom view of the fourth piece, according to an embodiment. FIG. 4D is a front view of the fourth piece, according to an embodiment. FIG. 4E is a rear view of the fourth piece, according to an embodiment.

Figure 5A:
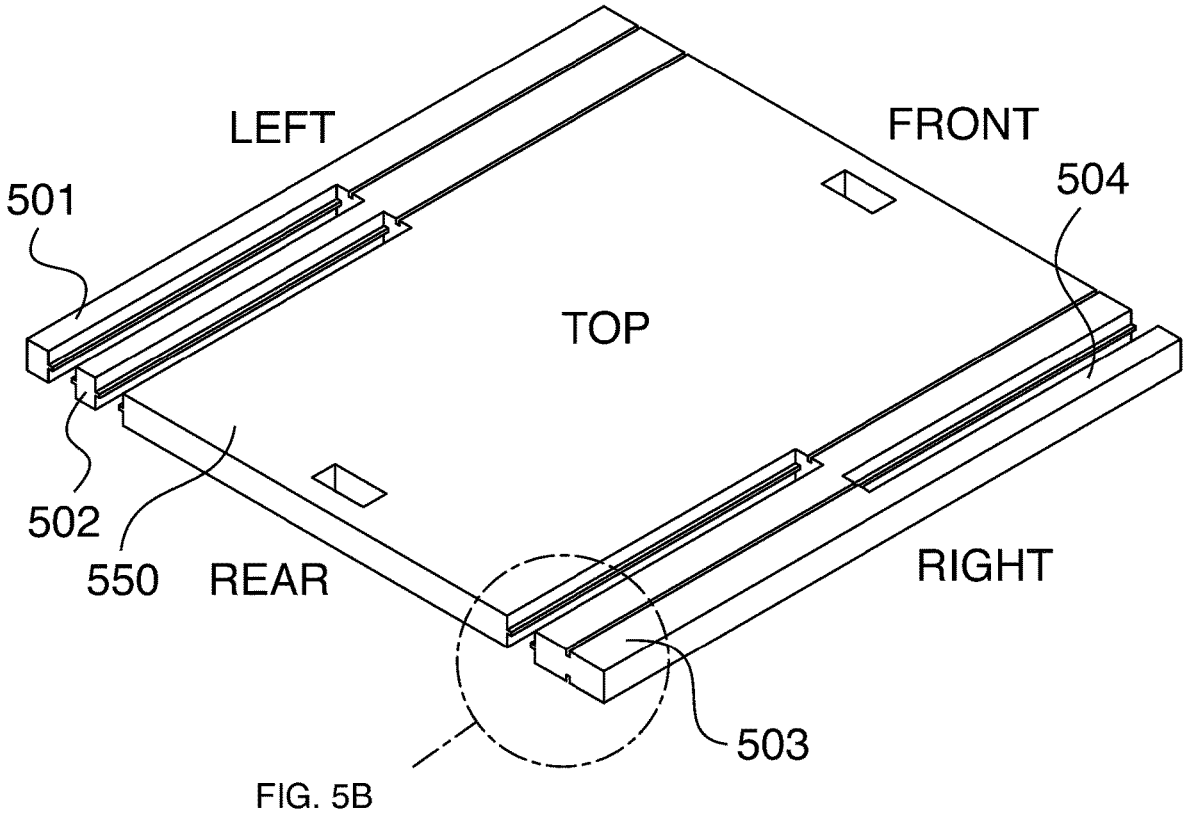
FIG. 5A is a diagonal top view of a fifth piece, according to an embodiment.
Figure 5B:
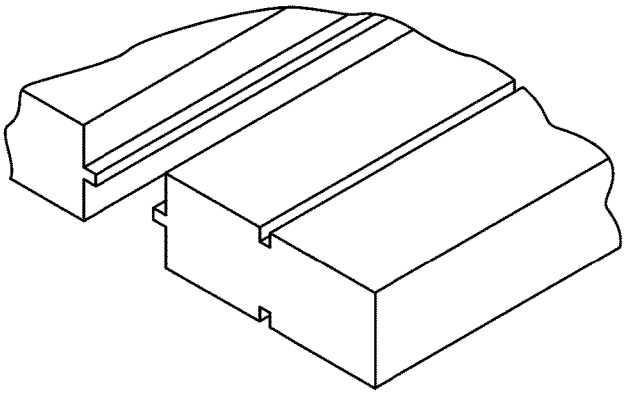
FIG. 5B is an enlarged drawing of the circles portion of FIG. 5A, according to an embodiment.

FIG. 5A is a diagonal top view of a fifth piece, according to an embodiment. FIG. 5B is an enlarged drawing of the circles portion of FIG. 5A, according to an embodiment.

The fifth piece (piece five) has four tines, 501 (first), 502 (second), 503 (third), 504 (fourth), one in front 504, and three in the rear 501, 502, 503. A middle section 550 is also present. Piece five also has four channels, one in the front and three in the rear. As shown, the locations of the channels (from left to right) is as follows: rear, rear, rear, front. A first channel is located between the first tine 501 and the second tine 502, a second channel is located between the second tine and the middle section 550, a third channel is located between the middle section 550 and the third tine 503, and a four channel is located between the middle section 550 and the fourth tine 504. As all of the pieces, the upper (top) half of piece five is symmetrical (identical) to the lower (bottom) half. The left side of piece five is not a mirror image of the right side.

Figure 5C:
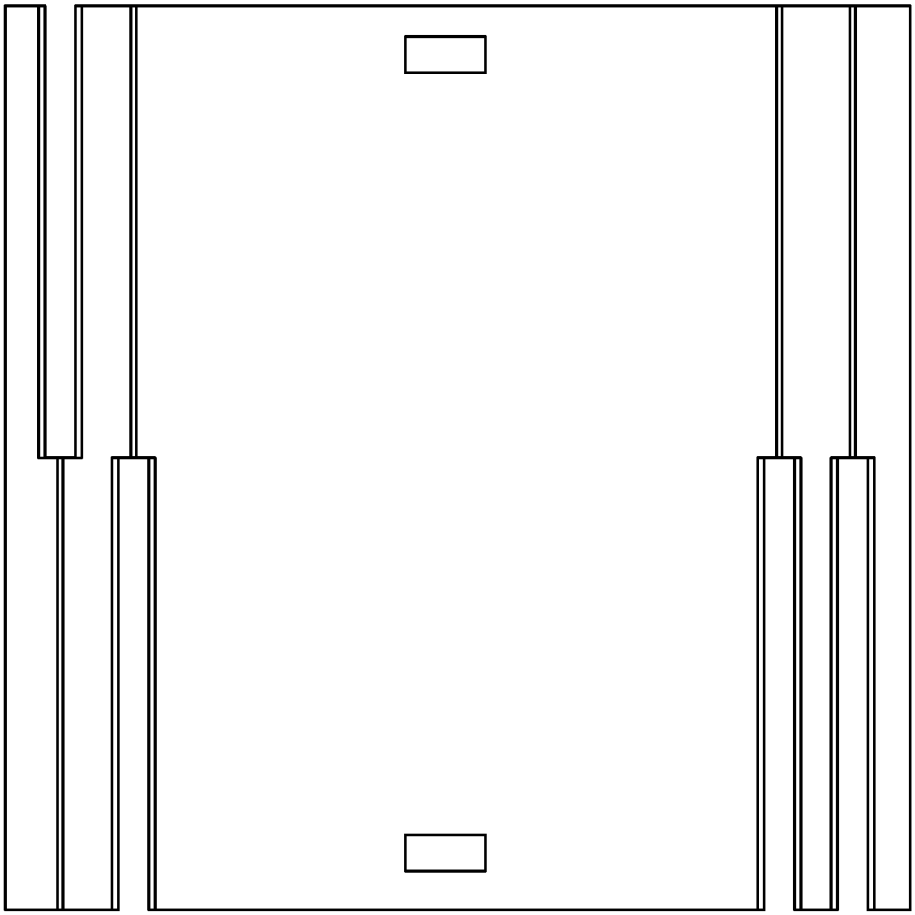
FIG. 5C is a bottom view of the fifth piece, according to an embodiment.
Figure 5D:
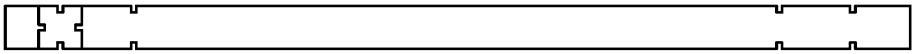
FIG. 5D is a front view of the fifth piece, according to an embodiment.
Figure 5E:
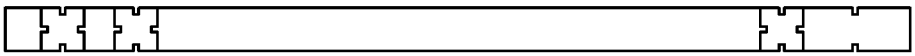
FIG. 5E is a rear view of the fifth piece, according to an embodiment.

FIG. 5C is a bottom view of the fifth piece, according to an embodiment. FIG. 5D is a front view of the fifth piece, according to an embodiment. FIG. 5E is a rear view of the fifth piece, according to an embodiment.

Figure 6A:
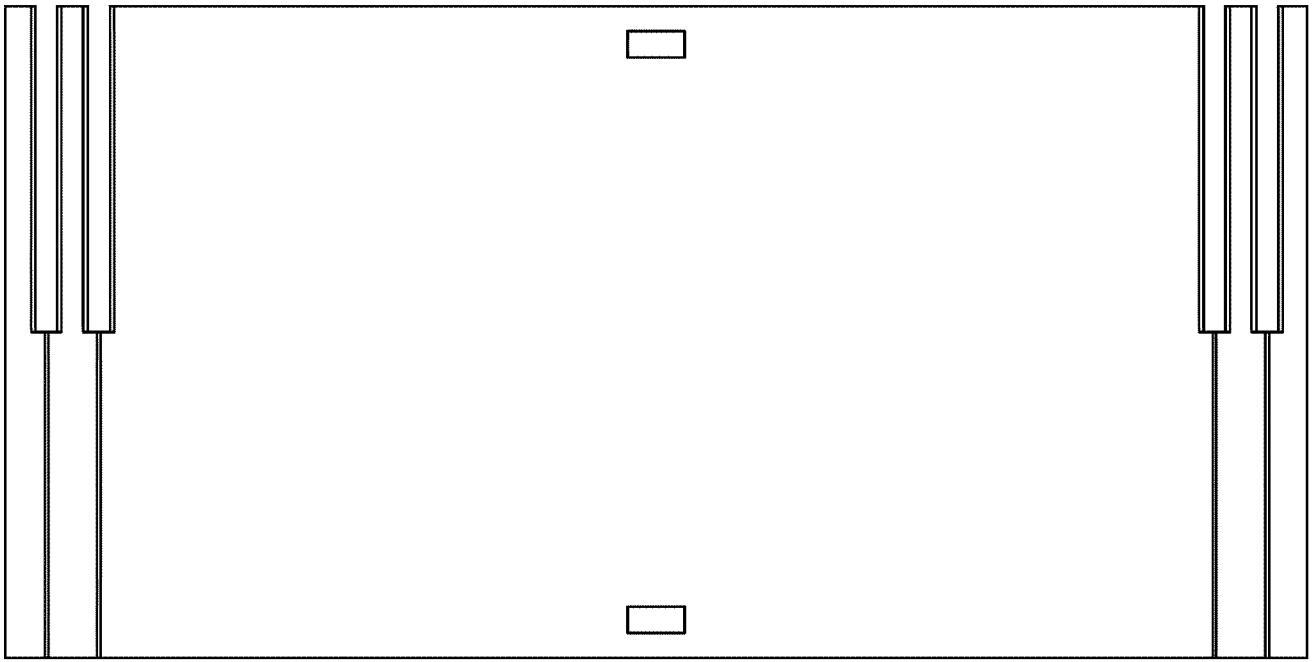
FIG. 6A is a bottom view of a wide first piece, according to an embodiment.
Figure 6B:
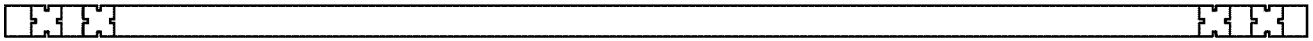
FIG. 6B is a rear view of the wide first piece, according to an embodiment.
Figure 6C:
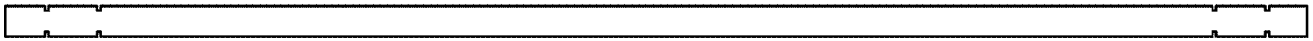
FIG. 6C is a front view of the wide first piece, according to an embodiment.

FIG. 6A is a bottom view of a wide first piece, according to an embodiment. The wide first piece has the same configuration/structure as the first piece but it is wider (as shown in FIGS. 6A, 6B, and 6C). FIG. 6B is a rear view of the wide first piece, according to an embodiment. FIG. 6C is a front view of the wide first piece, according to an embodiment. Any such width can be used.

All of the pieces shown in FIGS. 1-5 (standard pieces) can come in a wide version. The wide pieces would operate in the same manner as the standard pieces. Square boxes can be constructed with all for pieces of the same (compatible) dimensions. Alternatively, boxes can be constructed with wide pieces which oppose other matching wide pieces. A box can be formed with four compatible wide pieces. A box can also be formed with two wide pieces (opposing each other) and two standard (non-wide) pieces also opposing each other, thereby forming a non-square rectangle shape (instead of a square). Thus, boxes can be square but can also be non-square rectangular. Utilizing the wide pieces (as compared to the standard pieces) would provide additional storage space. A wide piece can interlock with a standard sized piece but you would need to have the pieces of matching width in opposition to each other to create a rectangular box. So, the 1-3-2-3 could be 1(wide)-3(standard)-2(wide)-3(standard). Although this can make a build-out (construction) a little more complicated, it actually provides for a dynamic solution with limited space. See FIG. 17 for an example of constructing rectangular and square boxes, according to an embodiment.

Figure 7A:
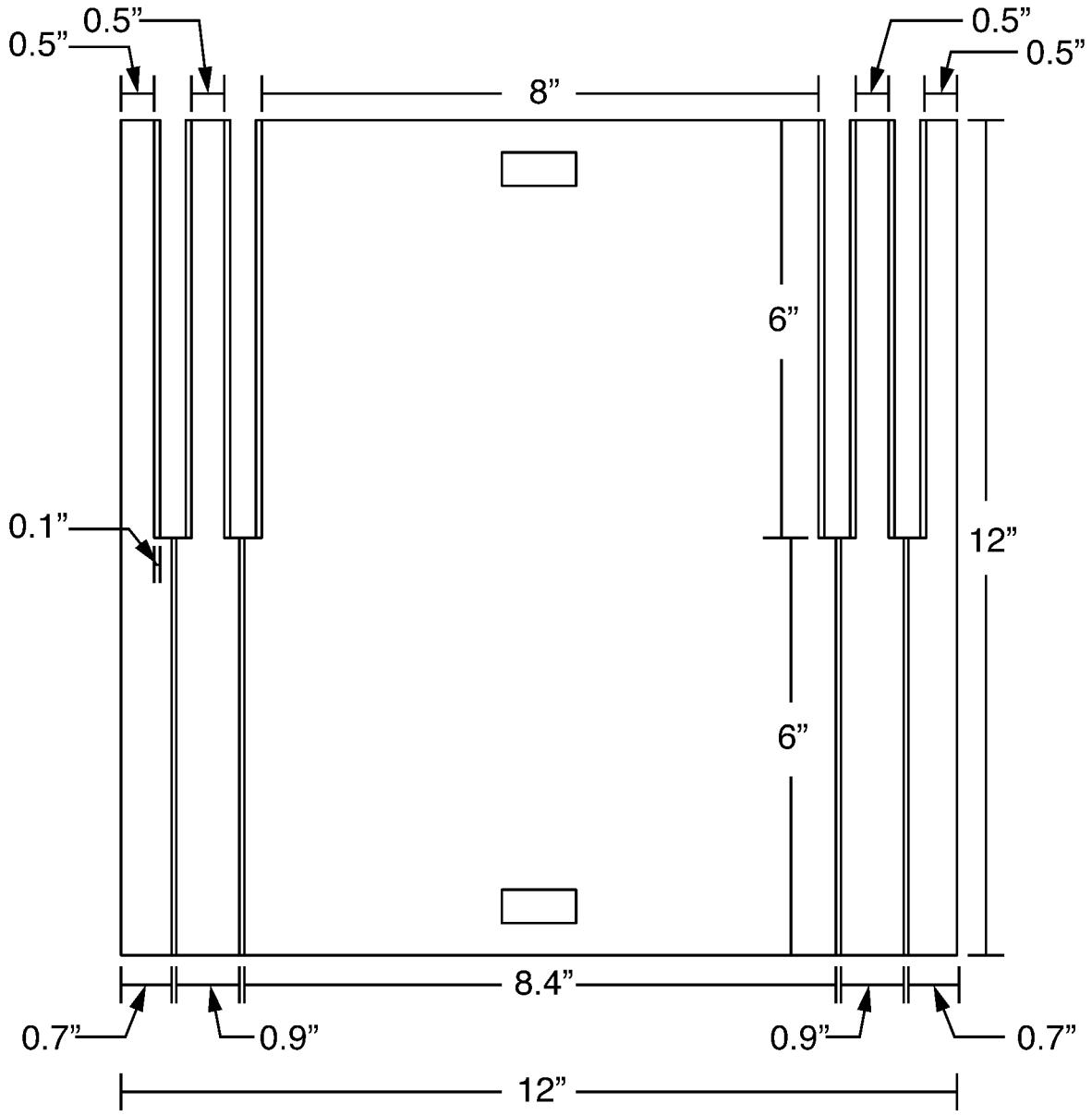
FIG. 7A is a bottom view of a first piece showing example dimensions, according to an embodiment.

FIG. 7A is a bottom view of a first piece showing example dimensions, according to an embodiment. Note that the middle section of 8.4 inches is longer than the tine length of 0.5 inches and the channel length which is 0.5 inches (from FIG. 7B). Note that the middle section (8.4 inches) is also longer than half of the entire side length (12 inches) and hence takes up the majority of the length of the side. Note that any embodiment described or illustrated herein also covers all variations of that embodiment, for example if one part is longer (or shorter) than another part, then all embodiments with that one part being longer (or shorter) are included. Also note that while FIGS. 7A, 7B, and 7C refer to the first piece, since all of the pieces can have the same or similar structure/dimensions, the dimensions shown herein in FIGS. 7A, 7B, 7C can be applied to all parts and all pieces.

Figure 7B:
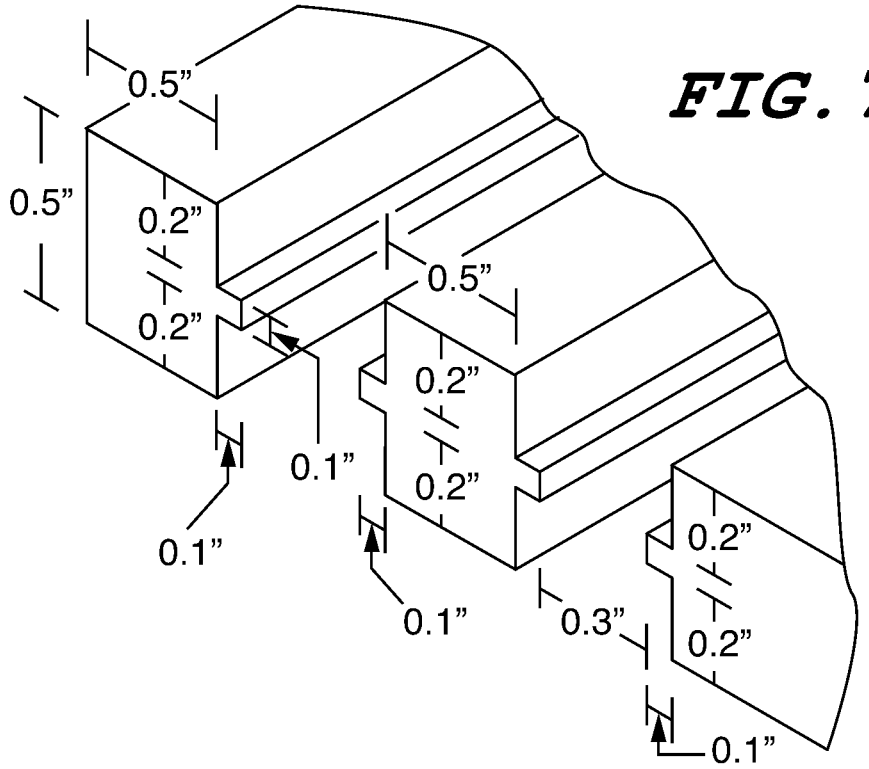
FIG. 7B is an enlarged view of the first piece from FIG. 7A showing example dimensions, according to an embodiment.
Figure 7C:
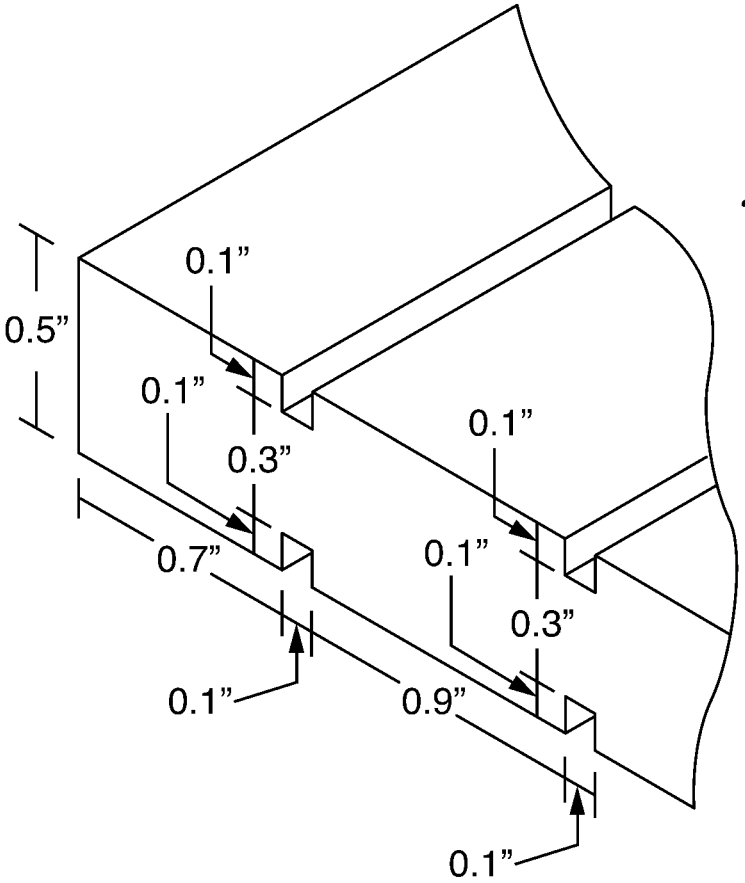
FIG. 7C is a further enlarged view of the first piece from FIG. 7A showing example dimensions, according to an embodiment.

FIG. 7B is an enlarged view of the first piece from FIG. 7A showing example dimensions, according to an embodiment. FIG. 7C is a further enlarged view of the first piece from FIG. 7A showing example dimensions, according to an embodiment.

Note that the dimensions of all pieces can follow the same structure so that they can interlock with each other properly. Thus, while FIGS. 7A, 7B, and 7C show dimensions for the first piece, the dimensions for any of the other pieces would have the same structure (e.g., same groove lengths, same sized channels, etc.)

Furthermore, it is noted that the dimensions shown in FIGS. 7A, 7B, and 7C are merely examples and other dimensions can be used as well, so long as all of the parts being used together are consistent so that they can interlock with each other properly.

Figure 8:
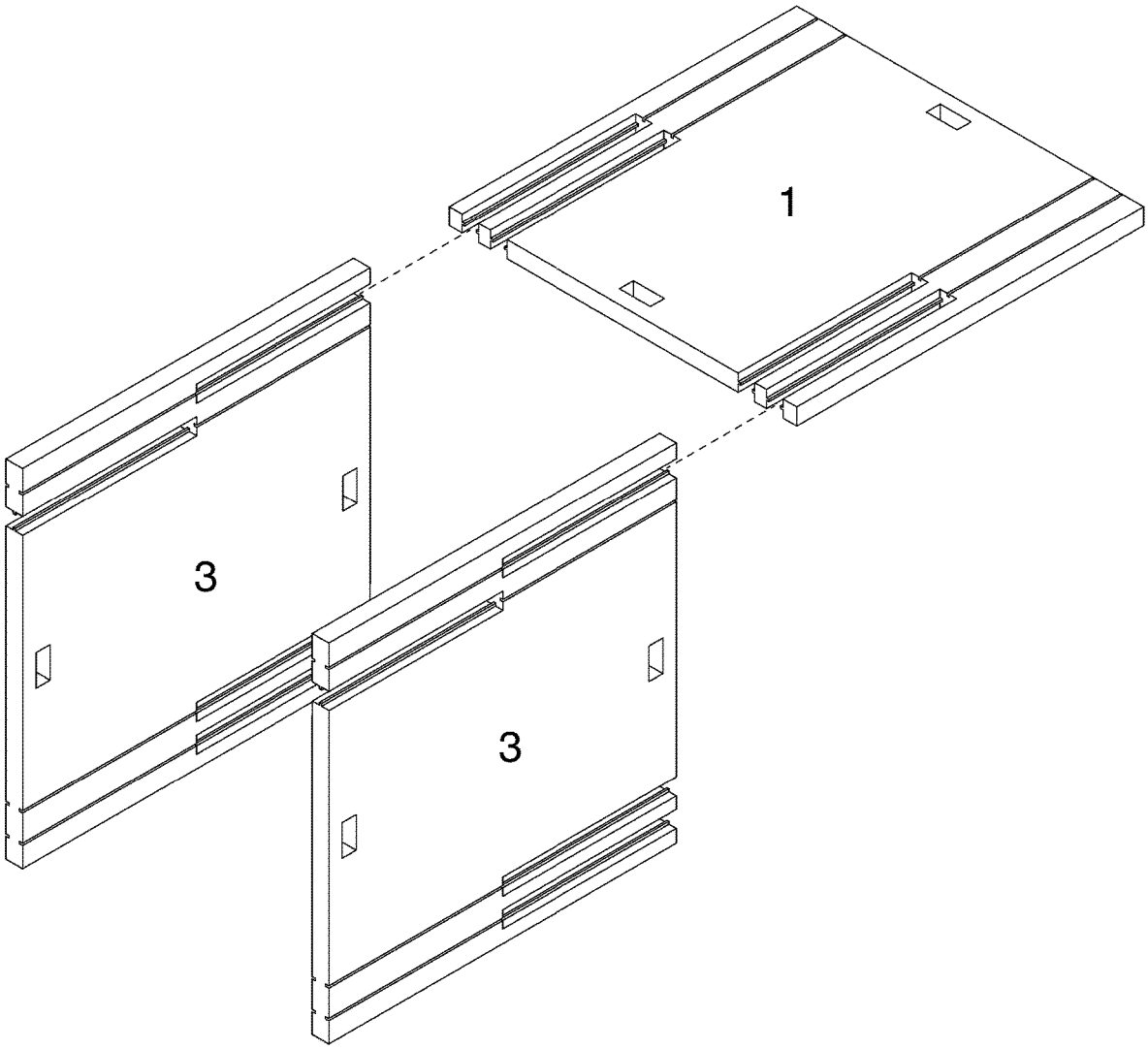
FIG. 8 is a drawing showing an assembly comprising the first piece and two third pieces, according to an embodiment.

FIG. 8 is a drawing showing an assembly comprising the first piece and two third pieces, according to an embodiment.

Pieces that are illustrated are numbered with their respective type of piece. For example, the piece numbered with '1' represents a first piece, the two planks numbered with '3' represents the third piece, etc. All pieces numbered as such represent their corresponding piece type.

In the configuration shown in FIG. 8, two third pieces are held parallel to each other and a first piece is slide into the respective channels as shown. Once the three pieces are locked together, then the assembly can proceed to FIG. 9.

Figure 9:
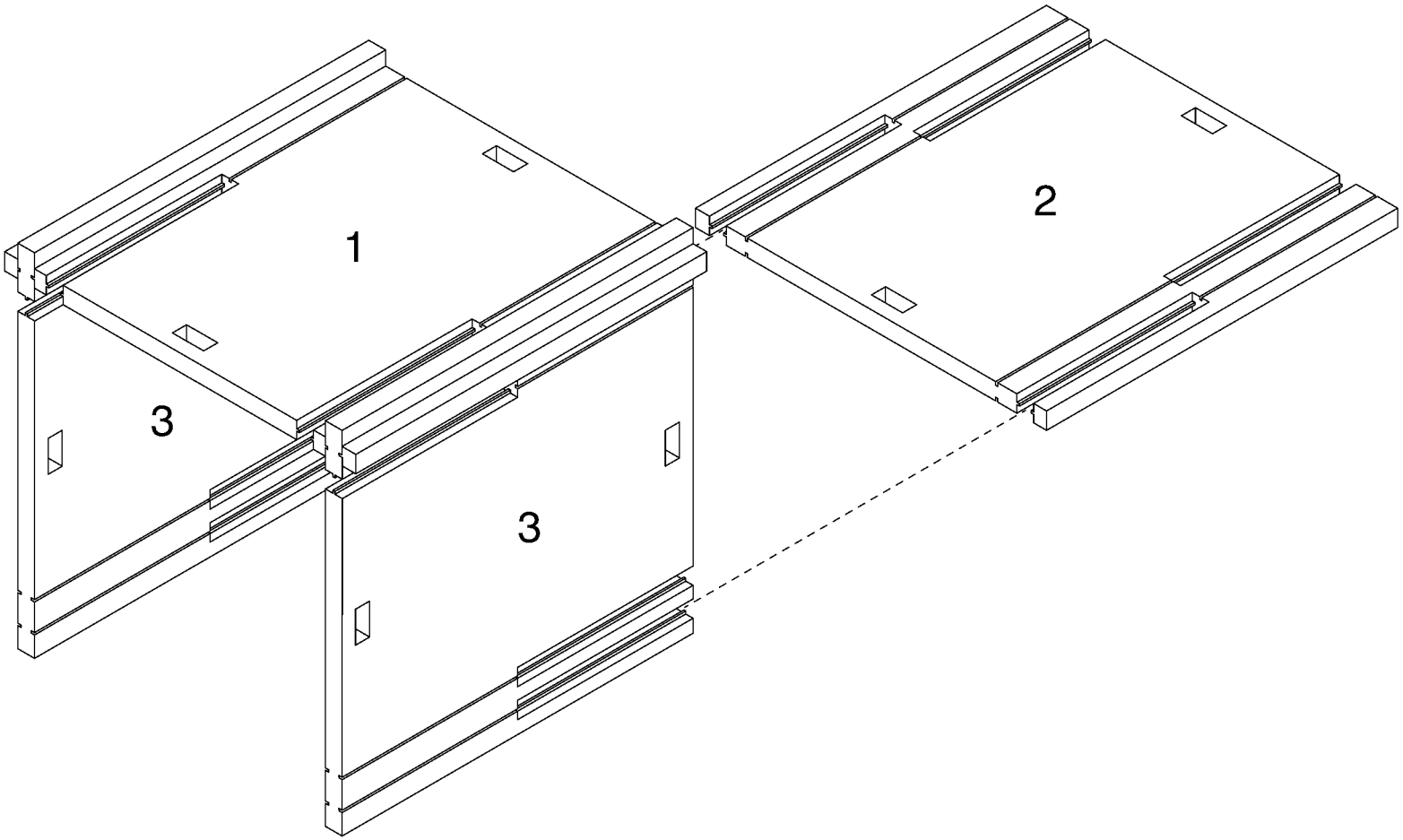
FIG. 9 is a drawing showing the assembly from FIG. 8 plus the second piece, according to an embodiment.

FIG. 9 is a drawing showing the assembly from FIG. 8 plus the second piece, according to an embodiment.

In FIG. 9 (follows from FIG. 8), a second piece is slid into the opposite ends of the third pieces as the first piece, as shown. This forms the box as shown in FIG. 10.

Figure 10:
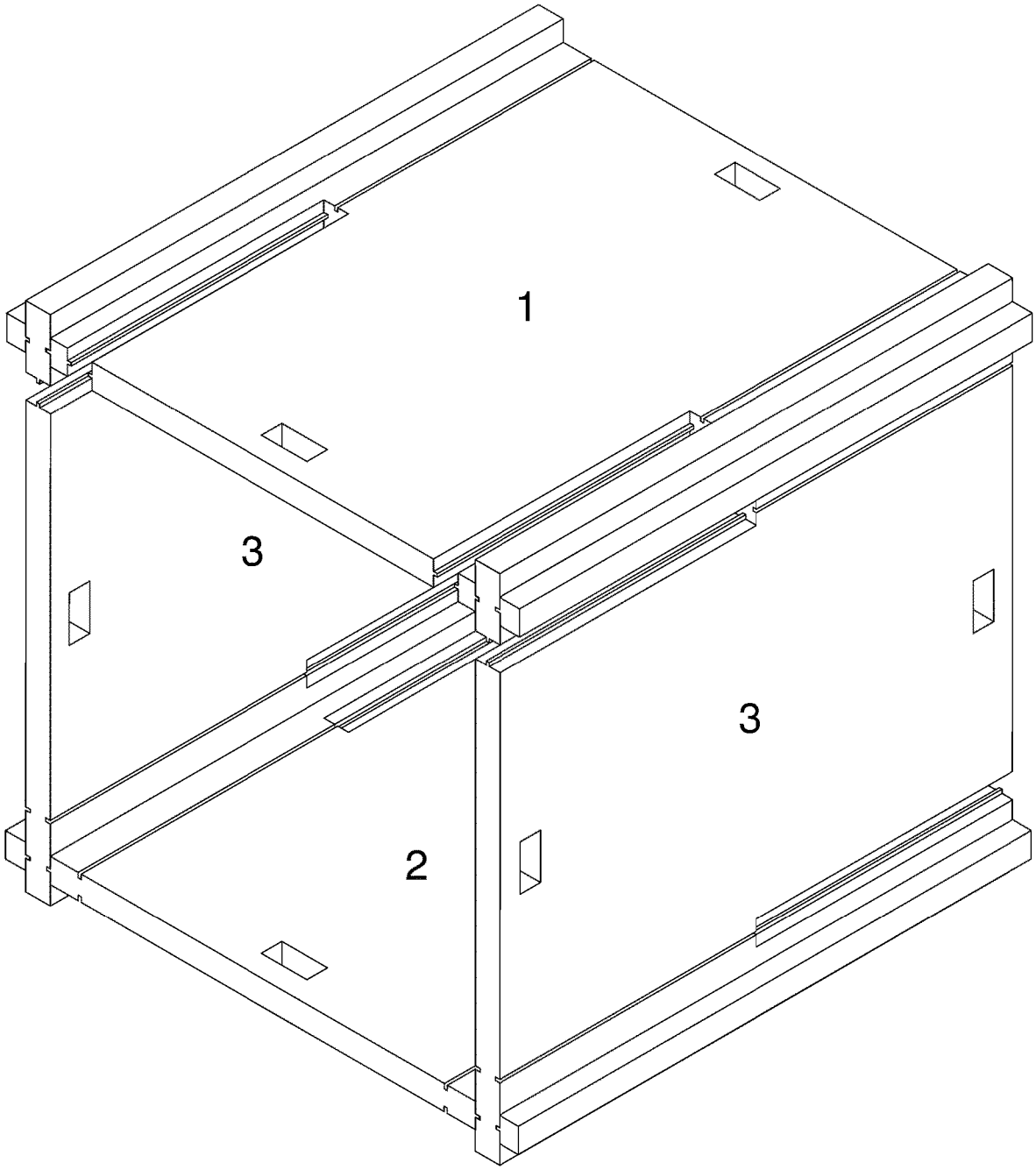
FIG. 10 is a drawing showing the assembly from FIG. 9 with all pieces fully interconnected with each other, according to an embodiment.

FIG. 10 is a drawing showing the assembly from FIG. 9 with all pieces fully interconnected with each other, according to an embodiment.

The four pieces (from FIG. 9), are pressed together tightly to form the box as shown which comprises two third pieces, a first piece, and a second piece.

Figure 11:
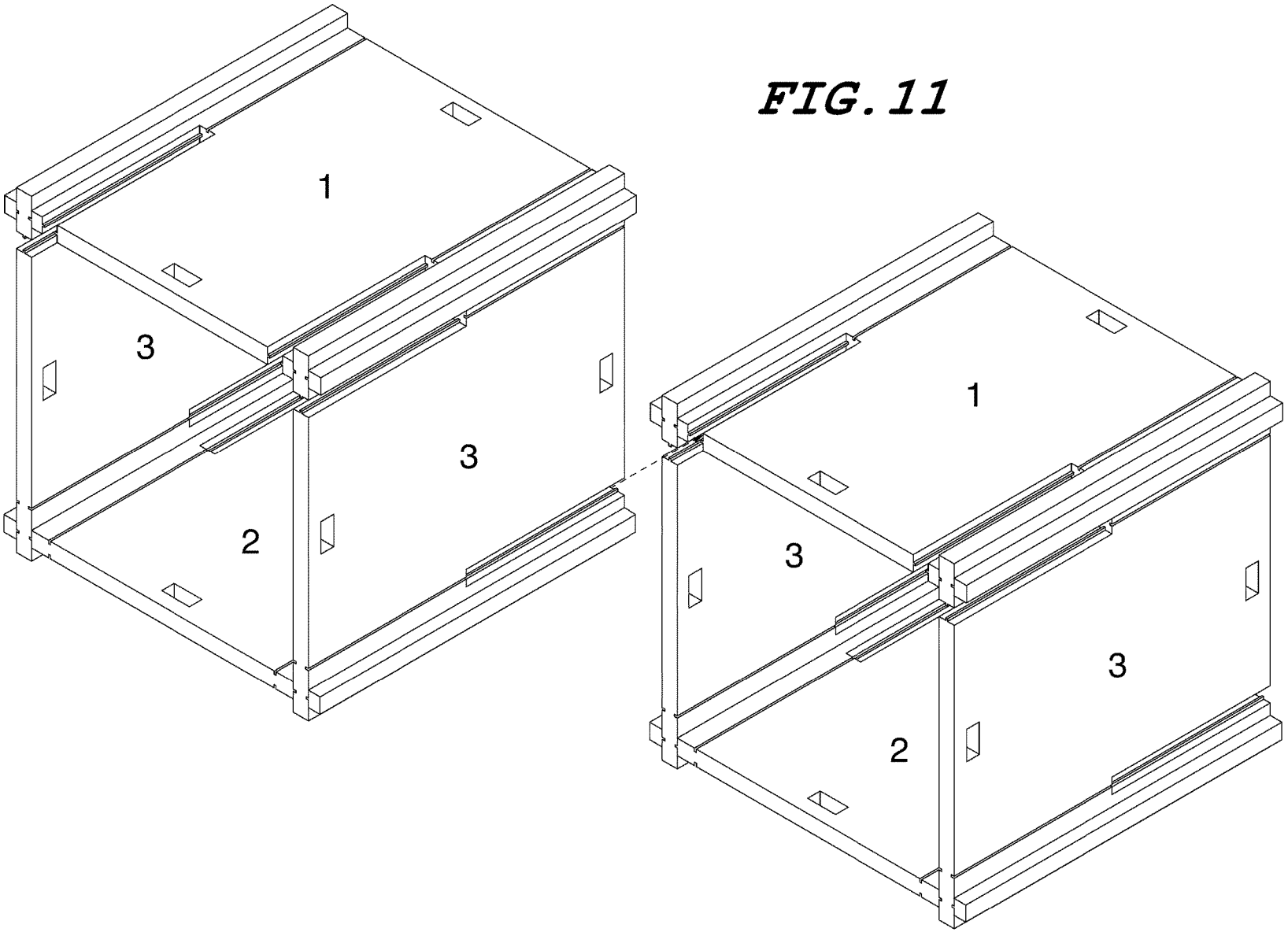
FIG. 11 is a drawing showing two of the assemblies shown in FIG. 10 aligned for connection therebetween, according to an embodiment.

FIG. 11 is a drawing showing two of the assemblies shown in FIG. 10 aligned for connection therebetween, according to an embodiment.

Two identical boxes that are shown in FIG. 10 are constructed side by side.

Figure 12:
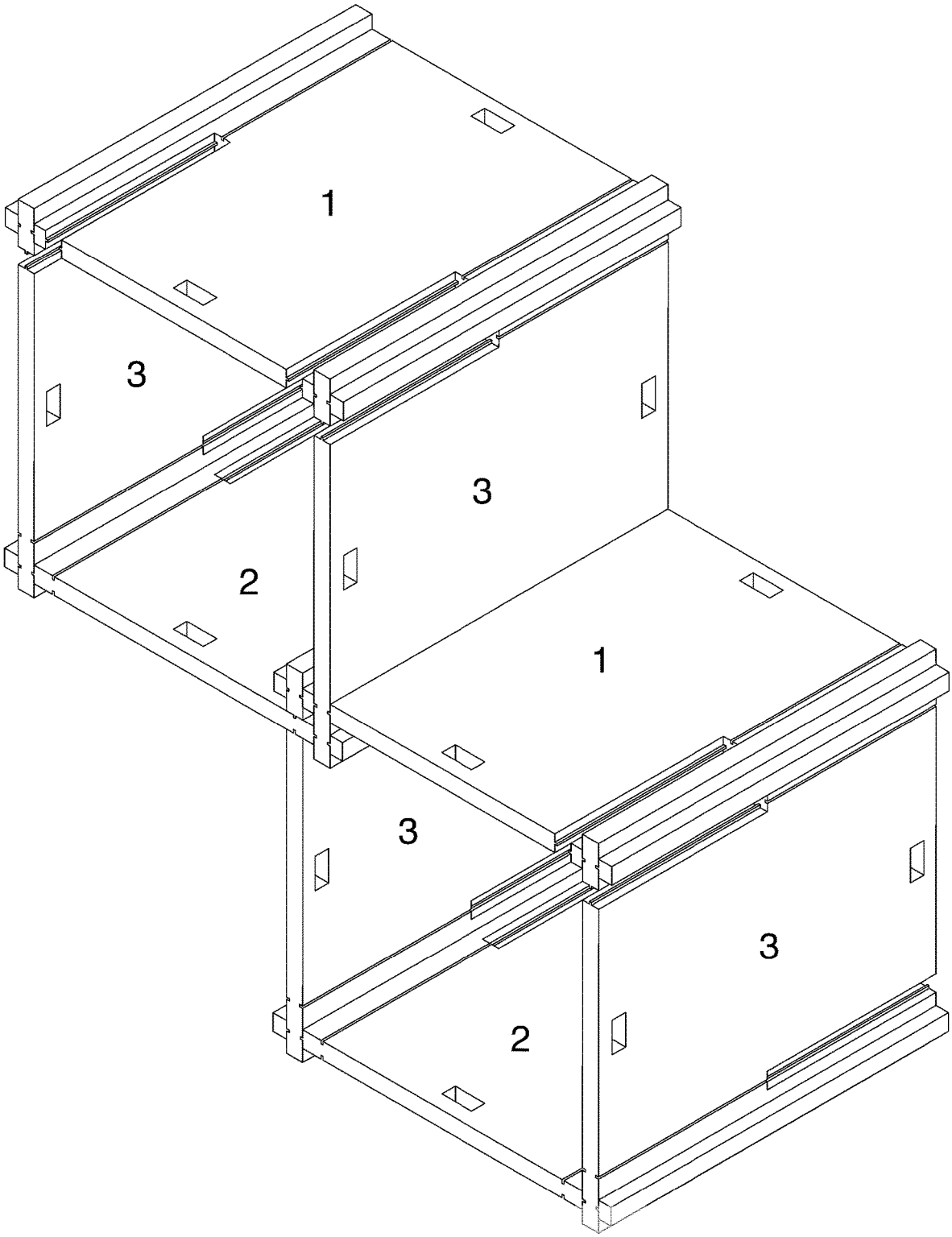
FIG. 12 is a drawing showing the two identical assemblies from FIG. 11 fully interconnected with each other, according to an embodiment.

FIG. 12 is a drawing showing the two identical assemblies from FIG. 11 fully interconnected with each other, according to an embodiment.

The two boxes shown in FIG. 11 can be joined together as shown in FIG. 12 by sliding a lower corner of a first box (the one shown on the left of FIG. 11) between piece 2 and piece 3 through an upper corner of the second box (the one shown in the right of FIG. 11) between piece 1 and piece 3. A channel in piece 2 of the first box slides into a channel in piece 3 of the second box, and a channel in piece 3 of the first box slides into a channel in piece 1 of the second box, as shown in FIGS. 11-12.

A stable two box structure is formed. Many such boxes can be constructed and added to the configuration to form a custom, modular shelf which rests on the ground (and can also have one side pushed against a wall).

Figure 13:
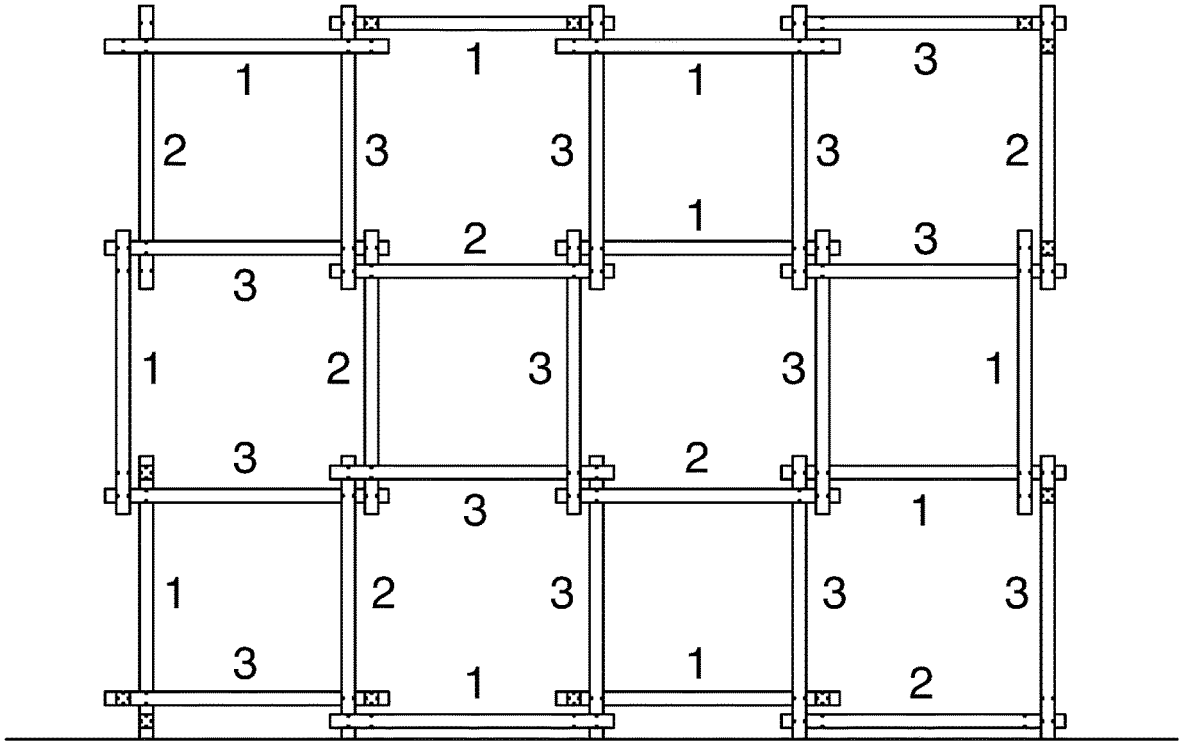
FIG. 13 is a drawing showing a configuration of multiple interconnected assemblies, according to an embodiment

FIG. 13 is a drawing showing a configuration of multiple interconnected assemblies, according to an embodiment.

This is one example of a configuration which uses pieces 1-3 (first piece, second piece, third piece) to form the modular shelf.

Figure 14:
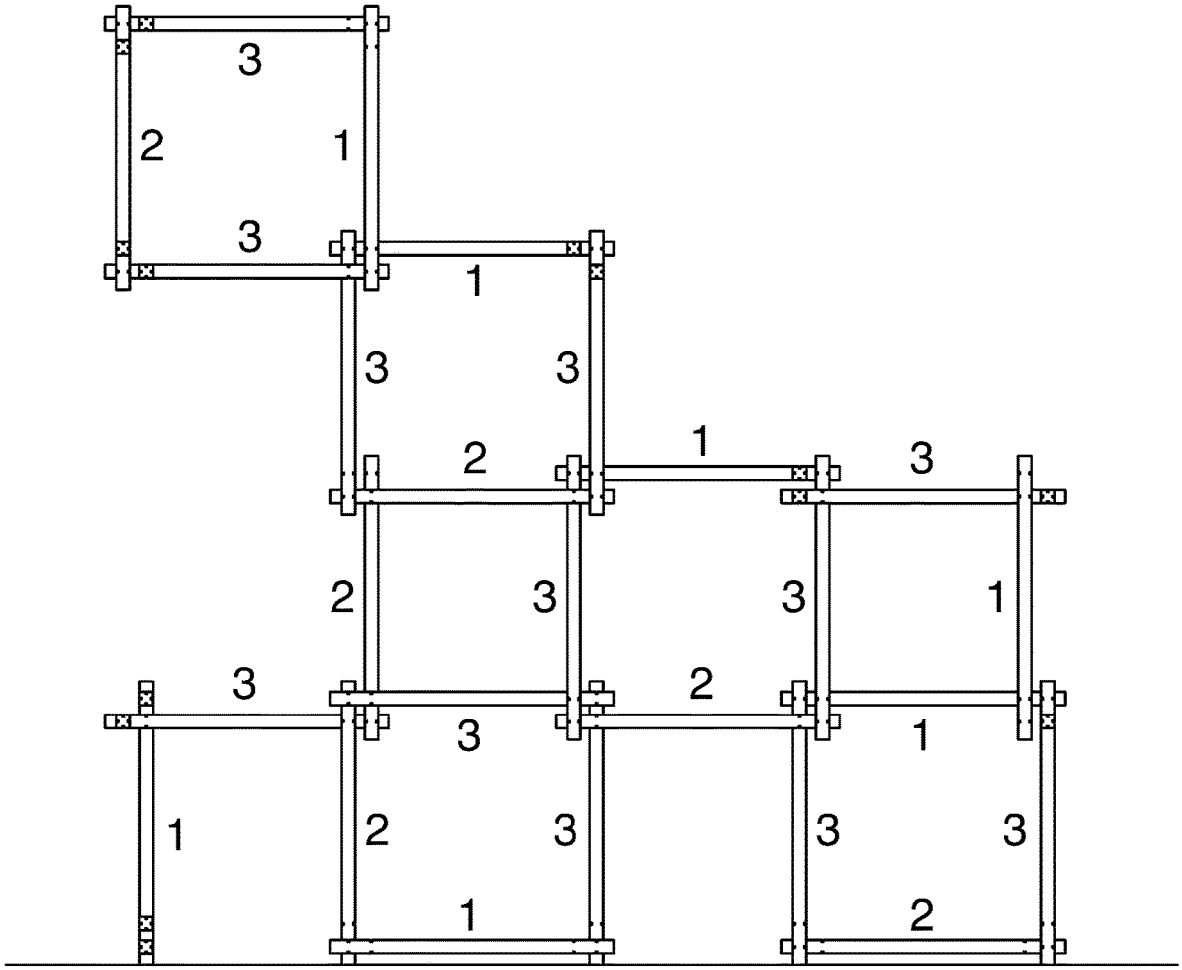
FIG. 14 is a drawing showing another configuration of multiple interconnected assemblies, according to an embodiment.

FIG. 14 is a drawing showing another configuration of multiple interconnected assemblies, according to an embodiment. FIG. 14 shows another example of how pieces 1, 2, and 3 can be joined together to form a shelf configuration.

Figure 15:
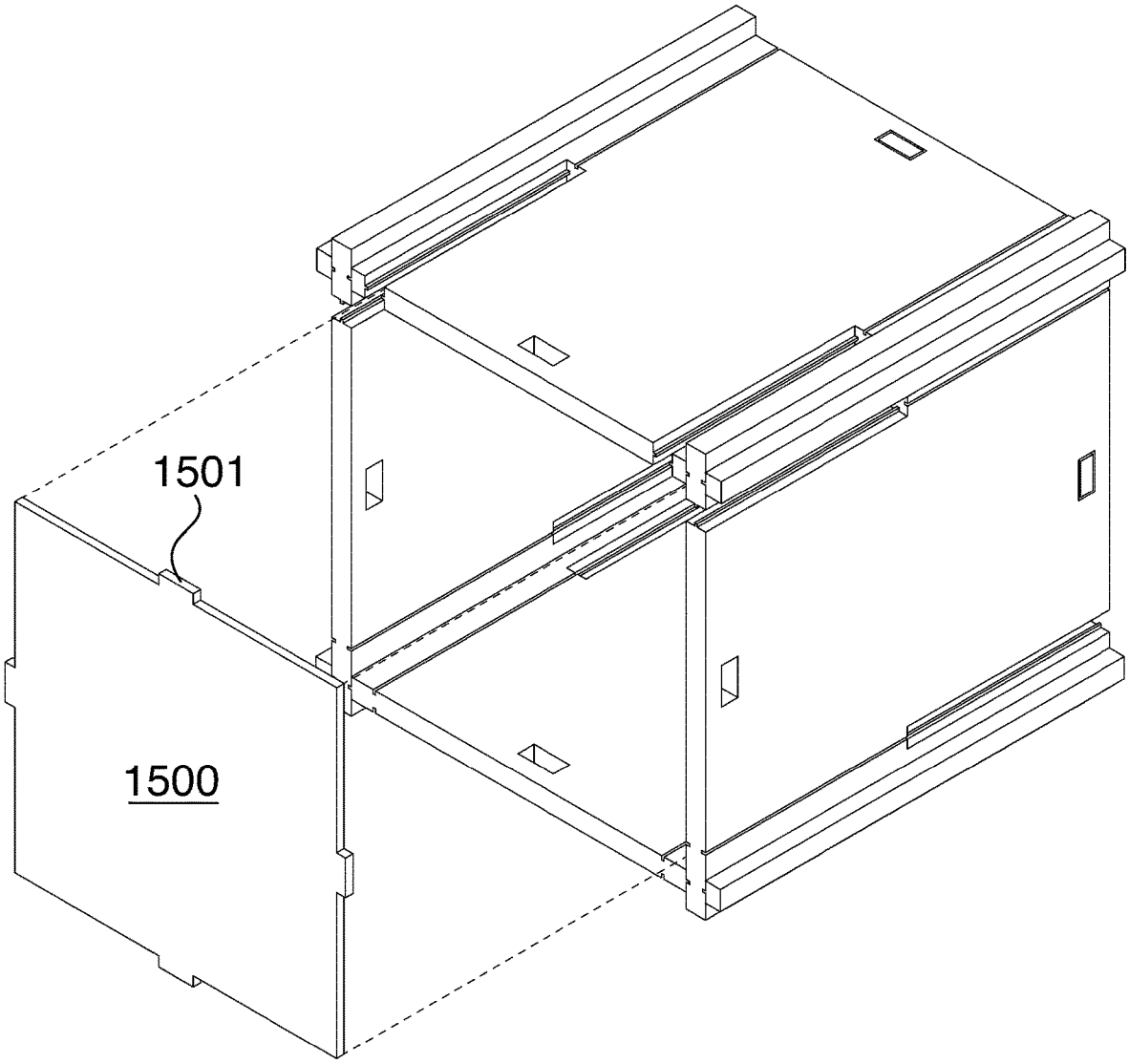
FIG. 15 is a drawing showing an assembly with an addition of a backing, according to an embodiment.

FIG. 15 is a drawing showing an assembly with an addition of a backing, according to an embodiment.

An optional backing 1500 (can be made of any material such as wood, cardboard, plastic, thick paper, etc.) has four tabs 1501 (only one such tab is numbered but there is a tab on each side of the backing 1500). Once a box is constructed, each of the four tabs can be pressed into a respective hole (as shown in FIG. 15), thereby forming a back (end) to the box. The backing would remain in place by virtue of the tabs 1501 having a snug fit with each respective hole in the pieces. In this manner, objects placed inside the box would not be pushed off the box in this direction since the backing is present to contain the objects. Of course, a backing would typically be only used on one side because if a backing was used on both sides of the box then there would be no way to insert objects inside the box. The backing 1500 would be easily inserted (placed) into the box (as shown) and also easily removed.

Figure 16:
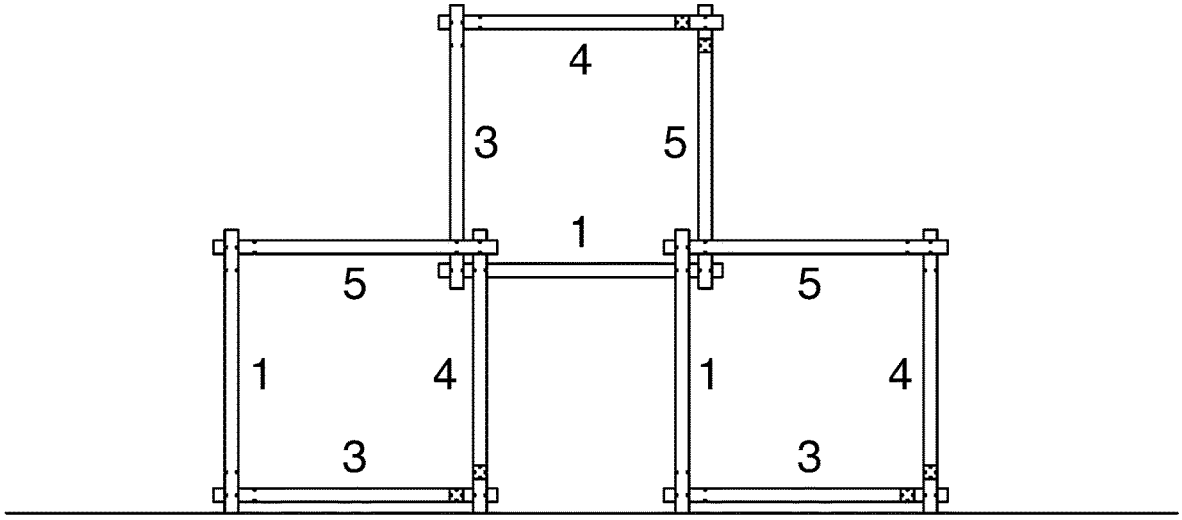
FIG. 16 is a drawing showing a further configuration of multiple interconnected assemblies, according to an embodiment.

FIG. 16 is a drawing showing a further configuration of multiple interconnected assemblies, according to an embodiment.

The configuration shown in FIG. 16 utilizes pieces 1, 3, 4 and 5. Many such boxes can be formed and joined as shown in order to create a modular shelf.

The pieces described herein can be used to create custom shelfs of any dimensions (subject to the sizes of the pieces themselves), in other words, such shelves can be constructed as high and as wide as a user desires. The pieces can all come in the same color or they can come in different colors as well. Users can enjoy constructing their own custom shelves using the pieces described herein to best fit the dimensions of the room. Any pieces described herein can be joined/combined with any other pieces described herein in any fashion to create boxes and join the boxes together to create a modular shelf.

Note that the configuration of a single box can be stated using four numbers representing each of its sides in order. For example, the box illustrated in FIG. 10 can be represented as 1-3-2-3. Note that this can alternatively be stated as any of: 3-2-3-1; 2-3-1-3-; 3-1-3-2.

Note that the following combinations (sequences) can be used to create boxes which can smoothly interlock (easily connect with another box because it has an interlocking corner that has the two inner grooves in parallel so it could easily slide into another box also with parallel inner grooves) with at least two other boxes in at least two corners: 1-1-2-2; 1-1-3-3; 1-1-4-4; 1-1-5-5; 1-2-3-2; 1-2-5-5; 1-3-1-3; 1-3-3-2; 1-3-4-5; 1-3-5-4; 1-5-1-5; 2-2-3-3; 2-2-5-5; 2-3-2-3; 2-3-4-5; 2-3-5-4; 2-4-3-5; 2-4-5-3; 2-5-2-5; 2-5-3-4; 2-5-4-3; 3-3-4-4; 3-4-3-4.

Note that the following combinations (sequences) can be used to create boxes which can smoothly interlock (easily connect with another box (e.g., cube) because it has an interlocking corner that has the two inner grooves in parallel so it could easily slide into another box also with parallel inner grooves) with other boxes in all four corners: 1-2-1-2; 1-2-3-3; 1-3-2-3; 1-4-1-4; 1-4-3-5; 1-4-5-3; 1-5-2-5; 1-5-3-4; 1-5-4-3; 1-5-5-2; 3-3-3-3; 3-3-5-5; 3-5-3-5.

Note that the following combinations (sequences) can form boxes which do not smoothly interlock with any other boxes: 1-1-1-1; 2-2-2-2; 2-2-4-4, and 2-4-2-4. Note that as long as a combination (sequence) can create a box, it can technically interlock with any other box, but not necessarily "smoothly". The difference being that a smooth interlocker has an interlocking corner that has the two inner grooves in parallel (so could easily slide into another also with parallel inner grooves) but if the inner grooves for a corner are in opposition (not "smooth") then a user would have to build out the interlocking box with an opposition corner attached to that box first then build the box (or individual tiles) around that, so the simple sliding together functionality is gone and it's more complicated, but the boxes can still be interconnected).

Thus, a user could form any possible box type (whether stated herein or not) and join it with any other possible box type that would fit properly, and a lattice can be constructed by forming and adding more and more boxes to the structure. There is no limit to the size and ways in which boxes can be constructed and joined. A user only has to line up the channels in two different pieces and slide them together until they cannot be pressed into each other anymore. The box combinations stated above are examples but these are not intended to be an exhaustive list of the only boxes that can be formed using the pieces described herein.

Figure 17:
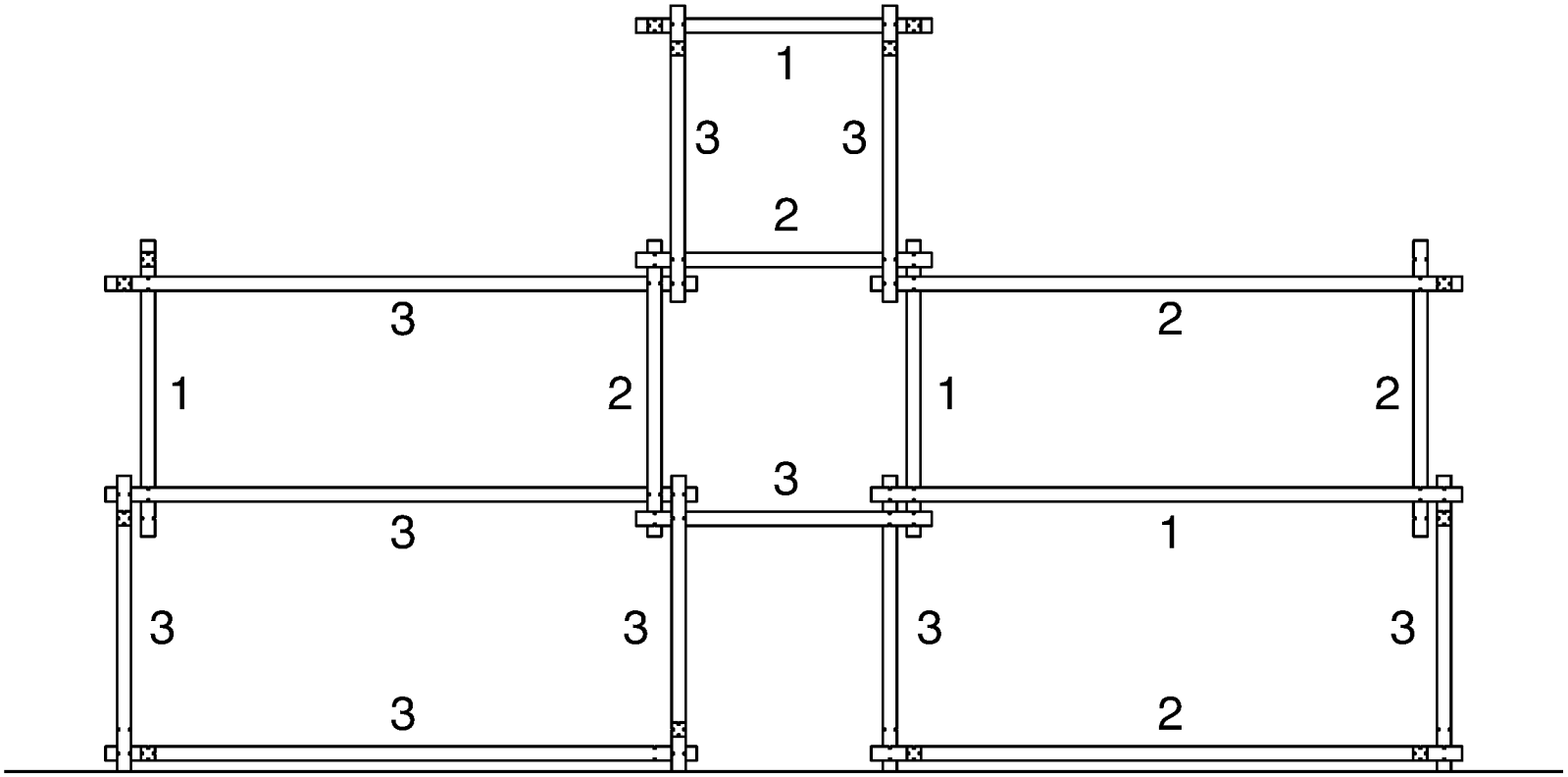
FIG. 17 is a drawing showing combining rectangular and square boxes, according to an embodiment.

FIG. 17 is a drawing showing combining rectangular and square boxes, according to an embodiment. As described herein, any combination/configuration of the pieces can be utilized which can form valid connections creating a stable structure, including combining wide and non-wide pieces (wide pieces having a different length from left to right than non-wide pieces while other dimensions of the pieces would remain the same) as shown in FIG. 17.

Note that all of the embodiments described and illustrated herein can be applied to both shelves (e.g., vertically stacked) as well as storage units (e.g., on the ground). For example any of the embodiments described and illustrated (or any others) can be constructed as one level resting on the ground (with or without the backing on the bottom which touches the ground), and the squares (boxes) therein can be used as storage (e.g., for storing pencils, tools, etc.). For example, see FIG. 15 but the box would be rotated such that the backing 1500 would be resting on the ground, table, etc. FIG. 16 (and any others) could be constructed horizontally (instead of vertically) which would mean FIG. 16 could be a top-down view (instead of a side view of the boxes were stacked vertically as shelves). If being used in this manner as a storage for pencils, then the size of the pieces can be smaller than as illustrated in FIGS. 7A, 7B, 7C, for example 25% (or any other scale) of the sizes shown. Thus, the inventive concept can be applied to vertically stacked shelves as well as a one level horizontal structure that rests on the ground.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A modular shelving apparatus, comprising:

a first piece comprising a top surface, a bottom surface, a first end, a second end, a right side, and a left side; wherein a first channel, a second channel, a third channel, and a fourth channel are each formed in the first end or the second end of the first piece and each extend from the top surface to the bottom surface;

wherein a first tine, a second tine, a third tine, and a fourth tine are formed on the first piece, the first tine and the second tine and the third tine and the fourth tine are all on the first end or the second end of the first piece, wherein the first channel is located between the first tine and the second tine, the second channel is between the second tine and a middle section, the third channel is between the middle section and the third tine, the fourth channel is between the third tine and the fourth tine, wherein the middle section is located between the second channel and the third channel;

a second piece comprising a top surface, a bottom surface, a first end, a second end, a right side, and a left side; wherein a fifth channel, a sixth channel, a seventh channel, and an eighth channel are each formed in the second piece and each extend from the top surface to the bottom surface of the second piece;

wherein a fifth tine, a sixth tine, a seventh tine, and an eighth tine are formed on the second piece, the fifth tine and the eighth tine are both located on the second end of the second piece and the sixth tine and the seventh tine are both located on the first end of the second piece opposite the second end, the fifth channel is located between the fifth tine and a middle section, the sixth channel is located between the sixth tine and the middle section, the seventh channel is located between the middle section and the seventh tine, and the eighth channel is located between the middle section and the eighth tine, the sixth channel and the seventh channel are located between the fifth channel and the eighth channel, wherein the middle section is located between the fifth channel and the eighth channel and also between the sixth channel and the seventh channel;

a third piece comprising a top surface, a bottom surface, a first end, a second end, a right side, and a left side; wherein a ninth channel, a tenth channel, an eleventh channel, and a twelfth channel are each formed in the third piece and each extend from the top surface to the bottom surface of the third piece;

wherein a ninth tine, a tenth tine, an eleventh tine, and a twelfth tine are formed on the third piece, the ninth tine and the tenth tine and the twelfth tine are all located on the second end of the third piece and the eleventh tine is located on the first end of the third piece opposite the second end, the ninth channel located between the ninth tine and the tenth tine, the tenth channel is located between the tenth tine and a middle section, the eleventh channel is located between the middle section and the eleventh tine, and the twelfth channel is located between the middle section and the twelfth tine, wherein the middle section is located between the tenth channel and the twelfth channel and also between the tenth channel and the eleventh channel; wherein the third piece further comprises a first pair of grooves in the top and bottom surfaces of the third piece, wherein the first pair of grooves spans between the ninth channel and the first end of the third piece, a second pair of grooves in the top and bottom surfaces of the third piece, wherein the second pair of grooves spans between the tenth channel and the first end of the third piece, a third pair of grooves in the top and bottom surfaces of the third piece, wherein the third pair of grooves spans between the eleventh channel and the second end of the third piece, and a fourth pair of grooves in the top and bottom surfaces of the third piece, wherein the fourth pair of grooves spans between the twelfth channel and the first end of the third piece, wherein the first pair of grooves, the second pair of grooves, the third pair of grooves, and the fourth pair of grooves each have a first width and a first depth, wherein the ninth channel, the tenth channel, the eleventh channel, and the twelfth channel each have a second width and a second depth, wherein the second width is larger than the first width and the second depth is larger than the first depth;

wherein the first piece is configured to slide into the third piece with the first channel engaging the twelfth channel, and wherein the third piece is configured to slide into the second piece with the fifth channel engaging the ninth channel.

2. The modular shelving apparatus as recited in claim 1, further comprising an additional third piece comprising a thirteenth tine, a fourteenth tine, a fifteenth tine, and a sixteenth tine, the thirteenth tine and the fourteenth tine and the sixteenth tine are all located on a second end of the additional third piece and the fifteenth tine is located on an opposing first end of the additional third piece, a thirteenth channel located between the thirteenth tine and the fourteenth tine, a fourteenth channel is located between the fourteenth tine and a middle section, a fifteenth channel is located between the middle section and the fifteenth tine, and a sixteenth channel is located between the middle section and the sixteenth tine, wherein the middle section is located between the fourteenth channel and the sixteenth channel and also between the fourteenth channel and the fifteenth channel;

wherein the first piece is configured to also slide into the additional third piece, wherein the second piece is configured to also slide into the additional third piece.

3. The modular shelving apparatus as recited in claim 2, wherein when the first piece is connected to both the third piece and the additional third piece, and the second piece is connected to both the third piece and the additional third piece, the first piece, the second piece, the third piece, and the additional third piece form a box.

4. The modular shelving apparatus as recited in claim 1, wherein the first channel of the first piece, the second channel of the first piece, the third channel of the first piece, and the fourth channel of the first piece each comprise a left ridge and a right ridge;

wherein the fifth channel of the second piece, the sixth channel of the second piece, the seventh channel of the second piece, and the eighth channel of the second piece each comprise a left ridge and a right ridge;

wherein the ninth channel of the third piece, the tenth channel of the third piece, the eleventh channel of the third piece, and the sixteenth channel of the third piece each comprise a left ridge and a right ridge.

5. The modular shelving apparatus as recited in claim 4, wherein the first piece further comprises a fifth pair of grooves extending between the first channel and the first end of the first piece, a sixth pair of grooves extending between the second channel and the first end of the first piece, a seventh pair of grooves extending between the third channel and the first end of the first piece, and an eighth pair of grooves extending between the fourth channel and the first end of the first piece.

6. The modular shelving apparatus as recited in claim 4, wherein the second piece further comprises a ninth pair of grooves extending between the fifth channel of the second piece, a tenth pair of grooves extending between the sixth channel of the second piece, an eleventh pair of grooves extending between the seventh channel of the second piece, and a twelfth pair of grooves extending between the eighth channel of the second piece.

7. The modular shelving apparatus as recited in claim 4, wherein the left ridge and the right ridge of the first channel of the first piece are configured to slide through the fourth pair of grooves in the third piece.

8. The modular shelving apparatus as recited in claim 6, wherein the left ridge and the right ridge of the fifth channel of the second piece are configured to slide through the first pair of grooves in the third piece.

9. The modular shelving apparatus as recited in claim 1, further comprising:

a fourth piece comprising a seventeenth tine, an eighteenth tine, a nineteenth tine, and a twentieth tine, the seventeenth tine and the nineteenth tine both located on a second end of the fourth piece and the eighteenth tine and the twentieth tine both located on a first end of the fourth piece opposite the second end, a seventeenth channel located between the seventeenth tine and a middle section, an eighteenth channel is located between the eighteenth tine and the middle section, a nineteenth channel is located between the middle section and the nineteenth tine, and a twentieth channel is located between the middle section and the twentieth tine, the eighteenth channel and the nineteenth channel are located between the seventeenth channel and the twentieth channel, wherein the middle section is located between the seventeenth channel and the nineteenth channel and also between the eighteenth channel and the twentieth channel.

10. The modular shelving apparatus as recited in claim 1, further comprising:

a fifth piece comprising a twenty first tine, a twenty second tine, a twenty third tine, and a twenty fourth tine, the twenty first tine and the twenty second tine and the twenty third tine are all located on a second end of the fifth piece and the twenty fourth tine is located on a first end of the fifth piece opposite the second end, a twenty first channel is located between the twenty first tine and the twenty second tine, a twenty second channel is located between the twenty second tine and a middle section, a twenty third channel is located between the middle section and the twenty third tine, and a twenty fourth channel is located between the middle section and the twenty fourth tine, wherein the middle section is located between the twenty second channel and the twenty third channel and also between the twenty second channel and the twenty fourth channel.

11. The modular shelving apparatus as recited in claim 9, further comprising:

a fifth piece comprising a twenty first tine, a twenty second tine, a twenty third tine, and a twenty fourth tine, the twenty first tine and the twenty second tine and the twenty third tine are all located on a second end of the fifth piece and the twenty fourth tine is located on a first end of the fifth piece opposite the second end, a twenty first channel is located between the twenty first tine and the twenty second tine, a twenty second channel is located between the twenty second tine and a middle section, a twenty third channel is located between the middle section and the twenty third tine, and a twenty fourth channel is located between the middle section and the twenty fourth tine, wherein the middle section is located between the twenty second channel and the twenty third channel and also between the twenty second channel and the twenty fourth channel.

12. The modular shelving apparatus as recited in claim 1, wherein the second end of the first piece has a third width, wherein the middle section of the first piece is longer than half of the third width of the second end.

13. The modular shelving apparatus as recited in claim 1, wherein the first piece is substantially the same size as the third piece.

14. The modular shelving apparatus as recited in claim 1, wherein the first piece is larger than the third piece.

15. A method of assembling modular shelving, comprising the operation of:

providing a first piece comprising a top surface, a bottom surface, a first end, a second end, a right side, and a left side; wherein a first channel, a second channel, a third channel, and a fourth channel are each formed in the first end or the second end of the first piece and each extend from the top surface to the bottom surface;

wherein a first tine, a second tine, a third tine, and a fourth tine are formed on the first piece, the first tine and the second tine and the third tine and the fourth tine are all on the first end or the second end of the first piece, wherein the first channel is located between the first tine and the second tine, the second channel is between the second tine and a middle section, the third channel is between the middle section and the third tine, the fourth channel is between the third tine and the fourth tine, wherein the middle section is located between the second channel and the third channel;

providing a second piece comprising a top surface, a bottom surface, a first end, a second end, a right side, and a left side; wherein a fifth channel, a sixth channel, a seventh channel, and an eighth channel are each formed in the second piece and each extend from the top surface to the bottom surface of the second piece;

wherein a fifth tine, a sixth tine, a seventh tine, and an eighth tine are formed on the second piece, the fifth tine and the eighth tine are both located on the second end of the second piece and the sixth tine and the seventh tine are both located on the first end of the second piece opposite the second end, the fifth channel is located between the fifth tine and a middle section, the sixth channel is located between the sixth tine and the middle section, the seventh channel is located between the middle section and the seventh tine, and the eighth channel is located between the middle section and the eighth tine, the sixth channel and the seventh channel are located between the fifth channel and the eighth channel, wherein the middle section is located between the fifth channel and the eighth channel and also between the sixth channel and the seventh channel;

providing a third piece comprising a top surface, a bottom surface, a first end, a second end, a right side, and a left side; wherein a ninth channel, a tenth channel, an eleventh channel, and a twelfth channel are each formed in the third piece and each extend from the top surface to the bottom surface of the third piece;

wherein a ninth tine, a tenth tine, an eleventh tine, and a twelfth tine are formed on the third piece, the ninth tine and the tenth tine and the twelfth tine are all located on the second end of the third piece and the eleventh tine is located on the first end of the third piece opposite the second end, the ninth channel located between the ninth tine and the tenth tine, the tenth channel is located between the tenth tine and a middle section, the eleventh channel is located between the middle section and the eleventh tine, and the twelfth channel is located between the middle section and the twelfth tine, wherein the middle section is located between the tenth channel and the twelfth channel and also between the tenth channel and the eleventh channel; wherein the third piece further comprises a first pair of grooves in the top and bottom surfaces of the third piece, wherein the first pair of grooves spans between the ninth channel and the first end of the third piece, a second pair of grooves in the top and bottom surfaces of the third piece, wherein the second pair of grooves spans between the tenth channel and the first end of the third piece, a third pair of grooves in the top and bottom surfaces of the third piece, wherein the third pair of grooves spans between the eleventh channel and the second end of the third piece, and a fourth pair of grooves in the top and bottom surfaces of the third piece, wherein the fourth pair of grooves spans between the twelfth channel and the first end of the third piece, wherein the first pair of grooves, the second pair of grooves, the third pair of grooves, and the fourth pair of grooves each have a first width and a first depth, wherein the ninth channel, the tenth channel, the eleventh channel, and the twelfth channel each have a second width and a second depth, wherein the second width is larger than the first width and the second depth is larger than the first depth;

sliding the first piece into the third piece with the first channel engaging the twelfth channel, and sliding the third piece into the second piece with the fifth channel engaging the ninth channel.

16. The method of assembling modular shelving as recited in claim 15, further comprising the steps of: providing an additional third piece comprising a thirteenth tine, a fourteenth tine, a fifteenth tine, and a sixteenth tine, the thirteenth tine and the fourteenth tine and the sixteenth tine are all located on a second end of the additional third piece and the fifteenth tine is located on an opposing first end of the additional third piece, a thirteenth channel located between the thirteenth tine and the fourteenth tine, a fourteenth channel is located between the fourteenth tine and a middle section, a fifteenth channel is located between the middle section and the fifteenth tine, and a sixteenth channel is located between the middle section and the sixteenth tine, wherein the middle section is located between the fourteenth channel and the sixteenth channel and also between the fourteenth channel and the fifteenth channel;

sliding the first piece into the additional third piece; and sliding the second piece into the additional third piece to form a box.

* * * * *